US007896788B1

(12) United States Patent
Schall

(10) Patent No.: US 7,896,788 B1
(45) **Date of Patent: *Mar. 1, 2011**

(54) EXERCISE APPARATUS

(76) Inventor: Stanley Schall, Williamsport, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/403,936

(22) Filed: Mar. 13, 2009

Related U.S. Application Data

(63) Continuation of application No. 11/592,140, filed on Nov. 3, 2006, now Pat. No. 7,503,884, which is a continuation of application No. 09/310,965, filed on May 13, 1999, now abandoned.

(60) Provisional application No. 60/085,291, filed on May 13, 1998.

(51) Int. Cl.
*A63B 26/00* (2006.01)
*A63B 21/015* (2006.01)

(52) U.S. Cl. ..... 482/141; 482/115

(58) Field of Classification Search ..... 482/117–118, 482/141, 146–147, 44–45, 70–71
See application file for complete search history.

(56) References Cited

U.S. PATENT DOCUMENTS

| | | | | |
|---|---|---|---|---|
| 1,533,500 | A | 4/1925 | Hovda | |
| D120,140 | S | 4/1940 | Preston | |
| 2,256,001 | A | 9/1941 | Titus | |
| 2,351,293 | A | 6/1944 | Saunders | |
| D141,456 | S | 6/1945 | Karstadt | |
| 3,100,639 | A | 8/1963 | Bonewitz | |
| 3,454,273 | A | 7/1969 | Vogt | |
| 3,593,994 | A | 7/1971 | Anbar | |
| 4,026,279 | A | 5/1977 | Simjian | |
| 4,193,592 | A | 3/1980 | Bishow | |
| D255,372 | S | 6/1980 | Tidmore | |
| 4,291,873 | A | 9/1981 | Lee et al. | |
| 4,768,778 | A | 9/1988 | Thomas, Jr. | |
| 4,815,224 | A | 3/1989 | Miller | |
| 4,858,912 | A | 8/1989 | Boyd | |
| 4,905,994 | A | 3/1990 | Hartz | |
| 5,226,868 | A | 7/1993 | Montgomery | |
| 5,256,127 | A | 10/1993 | Yeh | |
| 5,306,223 | A | 4/1994 | Martinez | |
| 5,358,463 | A | 10/1994 | Fuentes | |
| D354,100 | S | 1/1995 | Tsay et al. | |
| 5,466,206 | A | 11/1995 | Fleming | |
| 5,547,460 | A | 8/1996 | Ishikawa | |
| D374,045 | S | 9/1996 | Ward, II | |
| 5,607,380 | A | 3/1997 | Duty | |
| 5,632,707 | A | 5/1997 | Daniel et al. | |
| 5,683,337 | A | 11/1997 | Zetocha et al. | |
| 5,766,119 | A | 6/1998 | Clark | |
| 5,813,958 | A | 9/1998 | Tomita | |
| 7,503,884 | B1 * | 3/2009 | Schall | 482/141 |

* cited by examiner

*Primary Examiner* — Fenn C Mathew
(74) *Attorney, Agent, or Firm* — Cahn & Samuels LLP

(57) ABSTRACT

An exercise apparatus used by an individual that is performing a variation of a push-up exercise. The exercise apparatus includes a footing, a lower housing, a lower housing cap, a bearing element, and an upper platform. The footing is attached to the lower housing and prevents the lower housing from rotating or laterally moving along a floor or other support surface. The upper platform rotates relative to the lower housing through the bearing element, which rests on the lower housing cap. The upper platform has either an ergonomical handle or a punch pad attached to it for an individual to utilize the exercise apparatus through.

18 Claims, 19 Drawing Sheets

Figure 1:
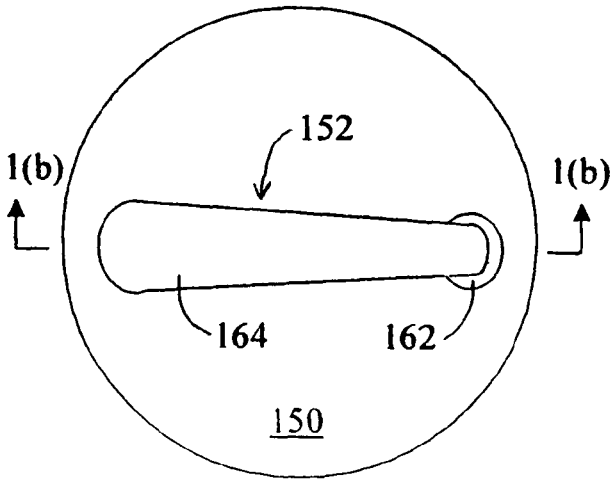

150c
196c
190c
6(b)
6(b)
198c

140a

130a

168c

167c

145c 170c
172c 172c
170c 164c
162c
160c

180c

166c 115
110c
121c
124c
111c

EXERCISE APPARATUS

This application is a continuation application of U.S. application Ser. No. 11/592,140, filed Nov. 3, 2006 and now U.S. Pat. No. 7,503,884, which is a continuation application of U.S. application Ser. No. 09/310,965, filed May 13, 1999, which claims priority from U.S. provisional Application Ser. No. 60/085,291, filed May 13, 1998. These patent applications are hereby incorporated by reference.

I. FIELD OF THE INVENTION

This invention relates to a physical exercising device for assisting an individual in performing push-ups. More particularly this invention is a mechanical exercising device having a rotating platform.

II. BACKGROUND OF THE INVENTION

The traditional practice of exercise known as a push-up yields limited muscular and coordination development due to the fixed and stationary nature of the hands. The traditional push-up is capable of causing an individual physical harm in the palm and wrist areas because of the fixed and stationary positioning of the hands to the surface the push-ups are being performed on (e.g., a floor) by the individual. The possible injuries that may occur include the hyperextension of the inner wrist tendons that results when the hands are placed flat on the floor and forearms are forced into a perpendicular position to both the floor and the hands. The traditional push-up movement also causes stresses to the bones and joints in the hands, the wrists, and the arms. Furthermore, the positioning of the hands relative to the arms in a traditional push-up is an awkward position that causes unnecessary pressures in the hands, the wrists, and the arms.

Numerous prior devices have attempted to enhance the scope of muscular and coordination development with a variety of rotating devices to allow the hands to rotate relative to the floor. Examples of prior attempts include U.S. Pat. No. 4,768,778 to Thomas, Jr. and U.S. Pat. No. 5,358,463 to Fuentes. Both of these patents provide examples of handles on a rotating piece that attempt to better match the natural positioning of the hand to the arm when the hand is gripping an object.

During a course of exercising over time, the human body adapts and strengthens to be able to perform exercises. Consequently, as the individual performs push-ups over time, the push-ups become easier to perform. To allow for further improvement and development of muscle and coordination, the rotational resistance in performing the push-up needs to be increased. The Fuentes patent is silent on adding resistance to the rotational mechanism. The Thomas, Jr. patent connects two devices together with a rubber band in a figure eight loop around the devices, which is limited to fixed intervals of increasing resistance to both devices. Thus, the prior art is not sufficiently developed to provide for independent and variable increases in resistance to the rotational movement of the handle.

The prior art when attempting to address these problems associated with the traditional push-up have provided elaborate mechanical designs that increases the likelihood that outside substances and particles may not be prevented from encroaching into the internal mechanical aspects of the devices.

Notwithstanding the usefulness of the above-described exercise devices, a need still exists for an exercise device that provides variable and settable rotational resistance for a rotating base with an ergonomical handle. Furthermore, an exercise device with a locking feature to prevent rotation is needed. A way to attach this type of exercise devices to weight machines securely to provide the benefits of allowing the hand to rotate relative to a flat plane is needed. An attachment to adjust the vertical height of an exercise device while allowing for rotation is needed.

III. SUMMARY OF THE INVENTION

This invention solves the ongoing and recurring problems of performing a push-up. The invention while addressing the problems of the prior art obtains advantages that were not achievable with the prior art devices.

An object of this invention is to make it safer by decreasing the likelihood of injuries from performing push-ups on a flat surface or performing repetitions on weight machines.

Another object of this invention is to provide a handle that fits better within a partially or completely closed hand.

Another object of this invention is to provide an adjustable level of rotational resistance.

Another object of this invention is to provide a simple mechanical apparatus that is not likely to break because of a complex design.

An advantage of this invention is its versatility for use performing push-ups or repetitions on a weight machine.

Another advantage is the ergonomically designed handle.

Another advantage is a wide range of resistance may be applied to increase or decrease the resistance for the rotation.

The invention accomplishes the above objectives and achieves the advantages. The invention is easily adapted to a wide variety of situations.

An exercise device including an upper platform having a handle extending therefrom, the handle having a short upright portion, a tall upright portion, and a gripping area connecting the short upright portion and the tall upright portion, the gripping area generally is tapered from the short upright portion to the tall upright portion such that a diameter of the gripping area adjacent to the short upright portion is greater than a diameter of the gripping area adjacent to the tall upright portion, the gripping area is joined to the short upright portion with an elbow and to the tall upright portion with an elbow; a lower housing engaging the upper platform; a lower housing cap abutting the lower housing and having an opening passing therethrough; and a bearing element adjacent to the upper platform and the lower housing cap.

An exercise device including a upper platform; a lower housing connected to the upper platform; a lower housing cap resting on and aligned with the lower housing; a bearing element resting on the lower housing cap and abutting the upper platform such that the bearing element allows the upper platform to rotate relative to the lower housing; and regulating components that control rotation between the lower housing and the upper platform.

An exercise device having a lower housing including a lower housing cap, a cylindrical base, and a rim around a periphery of the cylindrical base, the lower housing cap rests on the cylindrical base, the lower housing cap having an opening passing therethrough; a upper housing shrouding the lower housing base, the upper housing includes a platform, a cylindrical extension extending down from the platform, a handle extending upward from the platform, and a rim around an inside cavity of the cylindrical extension, the rim engages the rim of the lower housing; means for rotating the platform of the upper housing relative to the lower housing such that the lower housing remains stationary while the platform freely rotates on the lower housing, the means providing an opening passing therethrough aligned with the opening of the lower housing cap; and means for resisting rotation in communication with the lower housing and the upper housing, the means are internal to an internal space formed by the lower housing and the upper housing, the means passing through the opening in the lower housing cap and the opening in the rotating means.

Given the following enabling description of the drawings, the apparatus should become evident to a person of ordinary skill in the art.

IV. BRIEF DESCRIPTION OF THE DRAWINGS

The figures show cross-hatching to indicate the presence of solid material, and should not be viewed as indicating any particular type of material.

FIG. 1(*a*) illustrates a top view of the invention with a handle. FIG. 1(*b*) depicts a cross-section of FIG. 1(*a*). FIG. 1(*c*) illustrates the invention being gripped by a user's hand.

Figure 2:
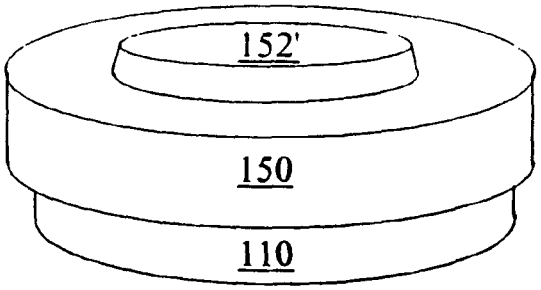
Figure 1:
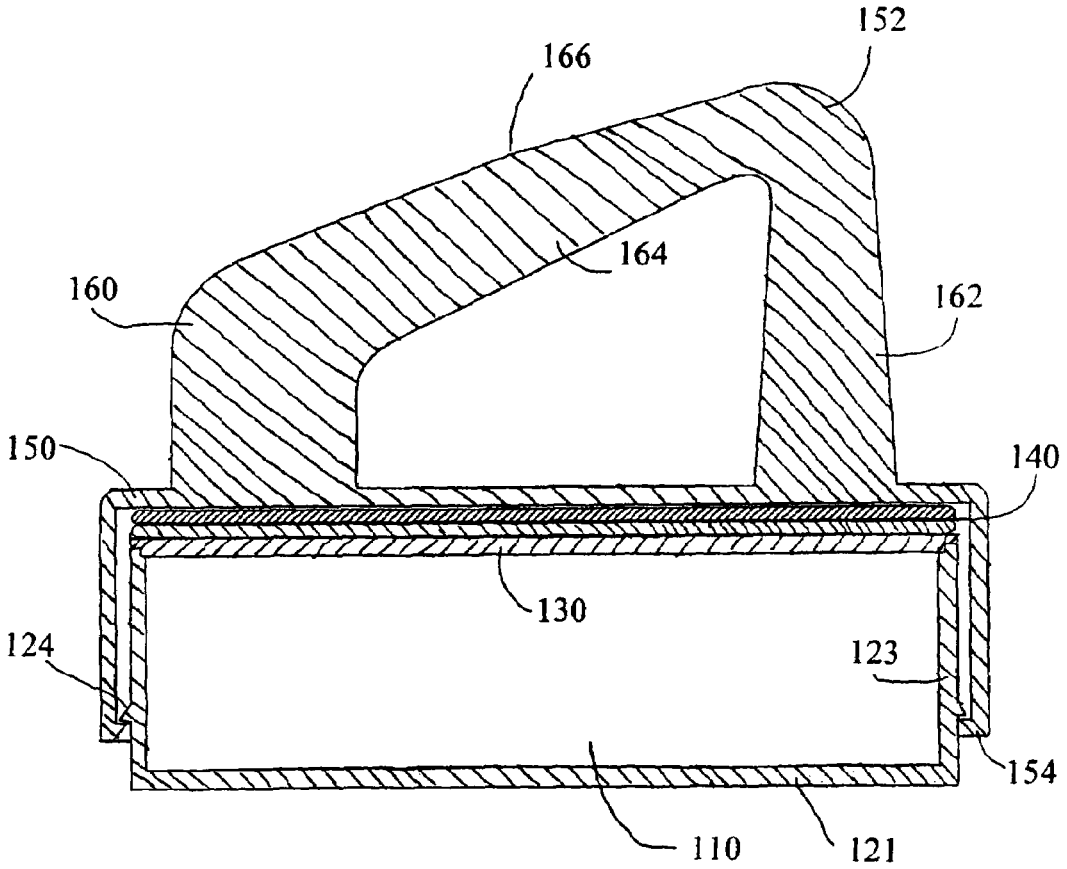
Figure 1:
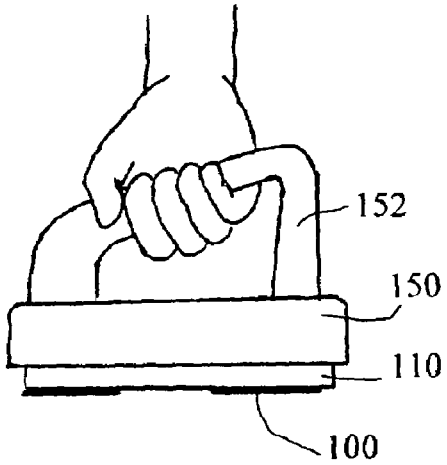
Figure 2:
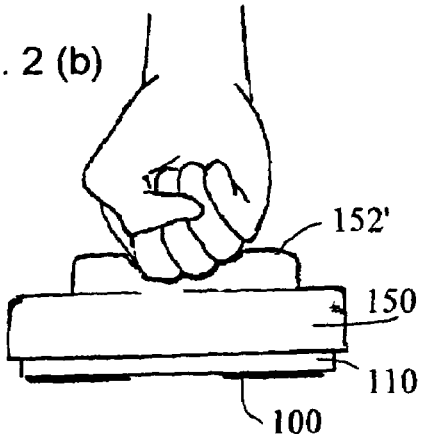
Figure 3:
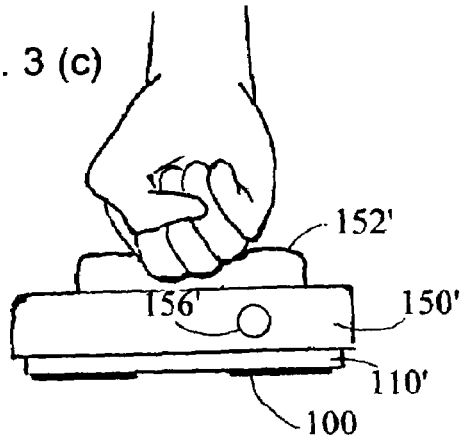
Figure 3:
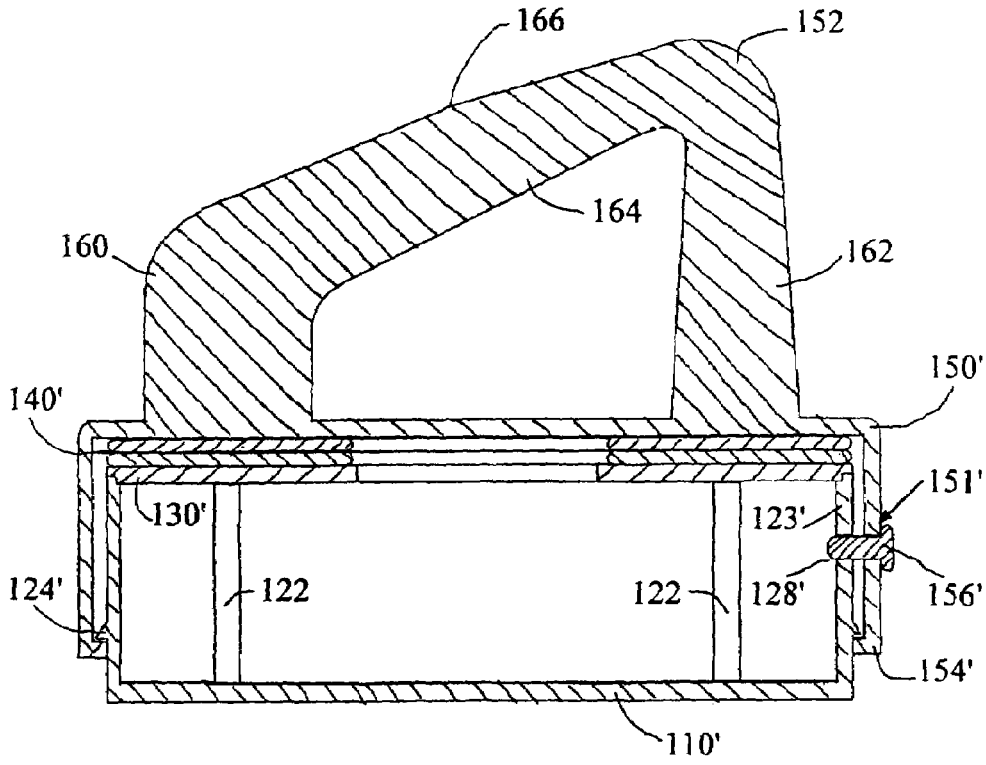

FIG. 2(*a*) depicts an angled view of the invention with a punch pad. FIG. 2(*b*) illustrates the invention in use with a hand.

Figure 3:
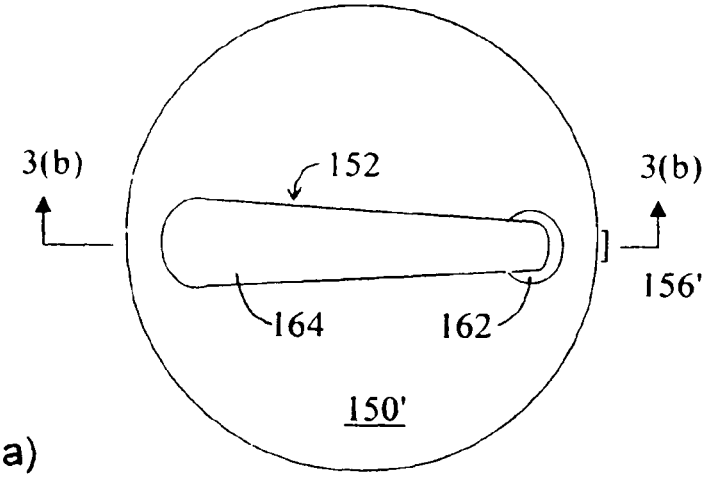

FIG. 3(*a*) illustrates a top view of the invention with a handle and a stopper. FIG. 3(*b*) illustrates a cross-section of FIG. 3(*a*). FIG. 3(*c*) depicts the invention with a punch pad in use and a stopper.

Figure 4A:
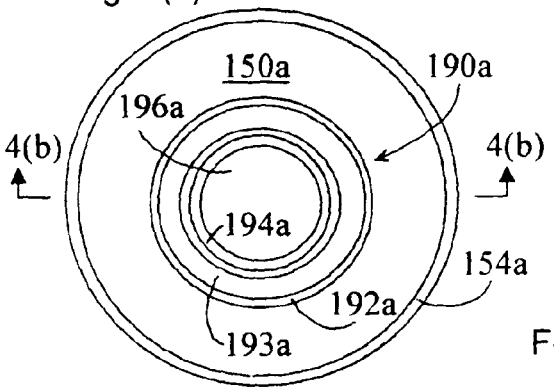
Figure 4C:
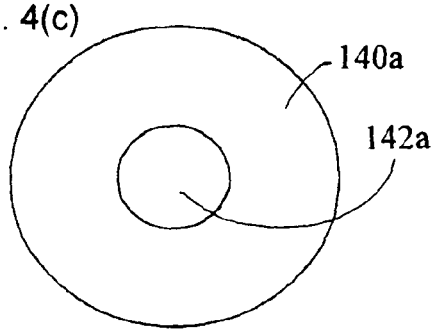
Figure 4D:
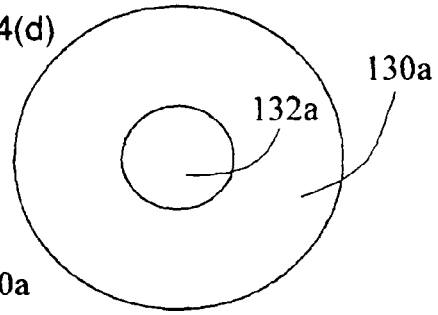
Figure 4E:
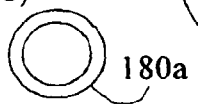
Figure 4I:
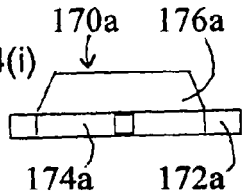
Figure 4F:
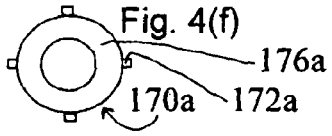
Figure 4J:
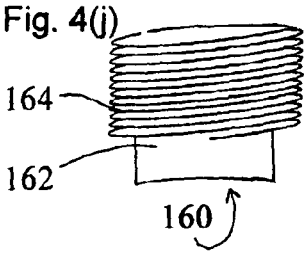
Figure 4G:
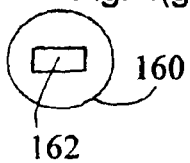
Figure 4H:
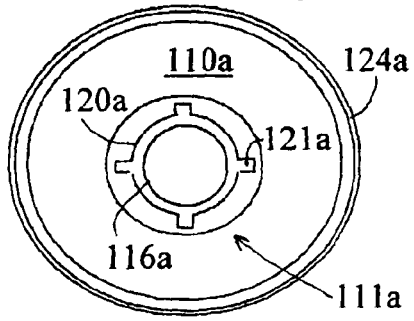
Figure 4:
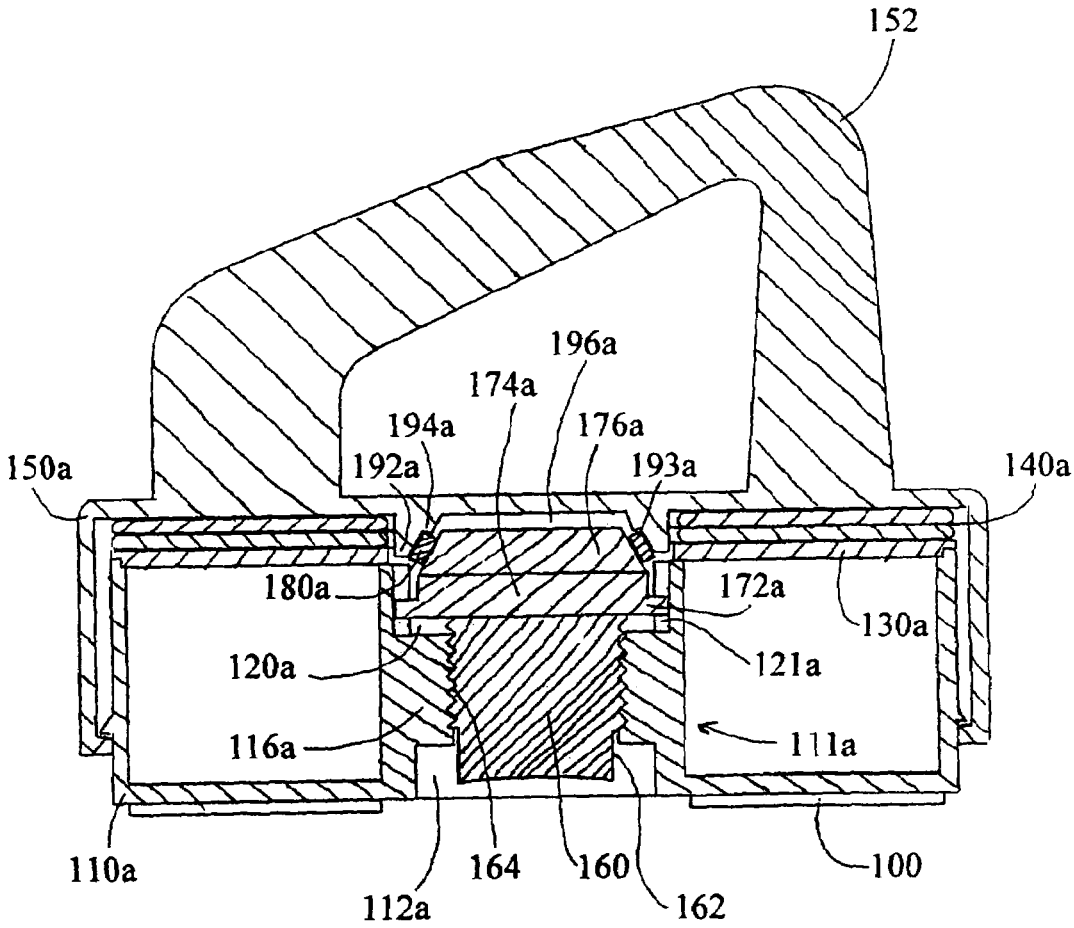

FIGS. 4(*a*)-(*j*) illustrate a preferred embodiment of the resistance components. FIGS. 4(*a*) depicts a bottom view of the upper housing. FIG. 4(*b*) illustrates a cross-section of this embodiment. FIGS. 4(*c*)-(*f*) and (*h*) illustrate top views of various components. FIG. 4(*g*) depicts a bottom view of the adjustment mechanism. FIGS. 4(*i*)-(*j*) illustrate side views of components.

Figure 5:
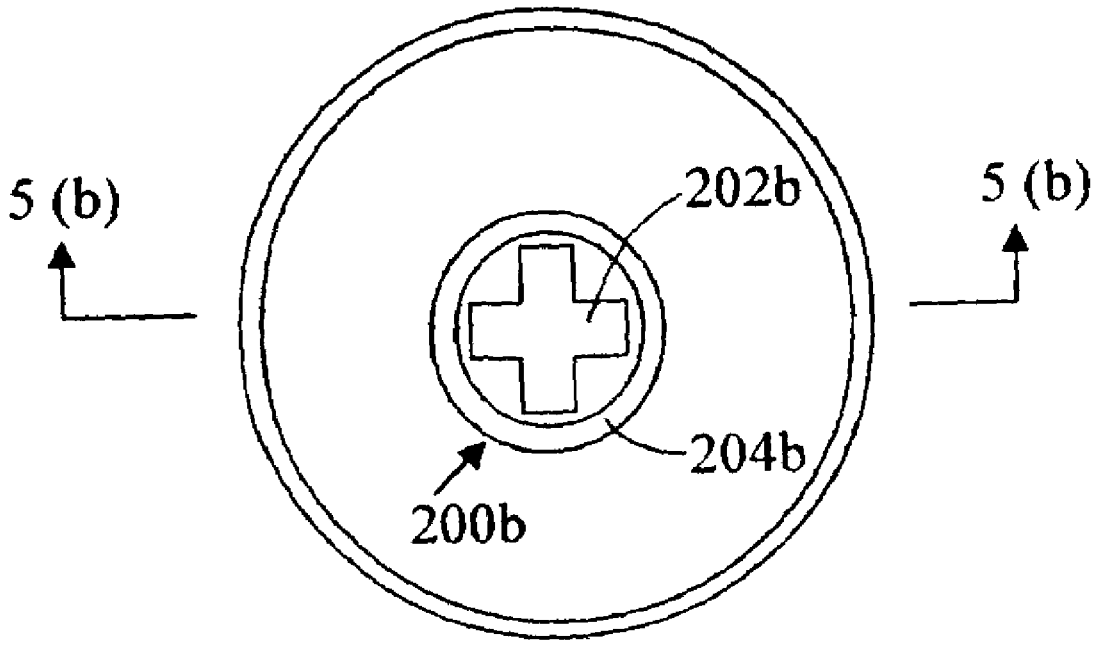
Figure 5:
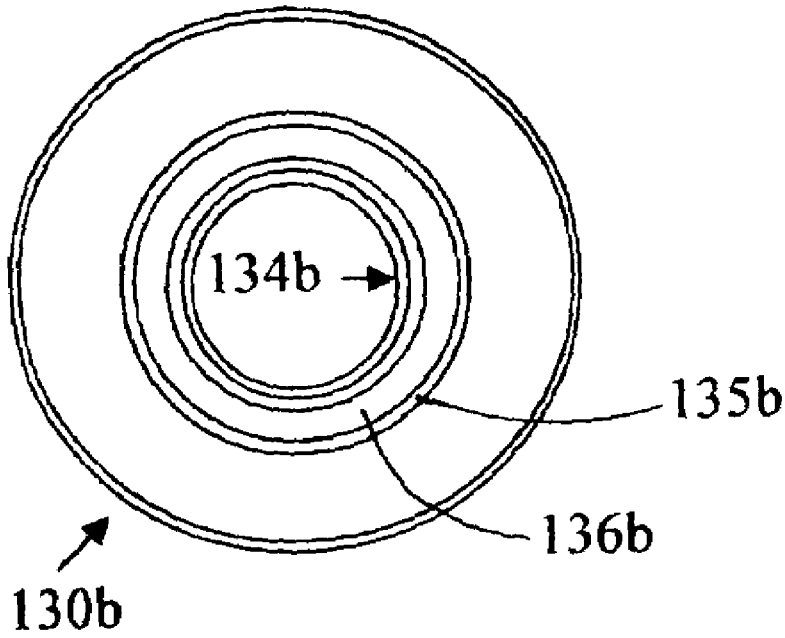
Figure 5:
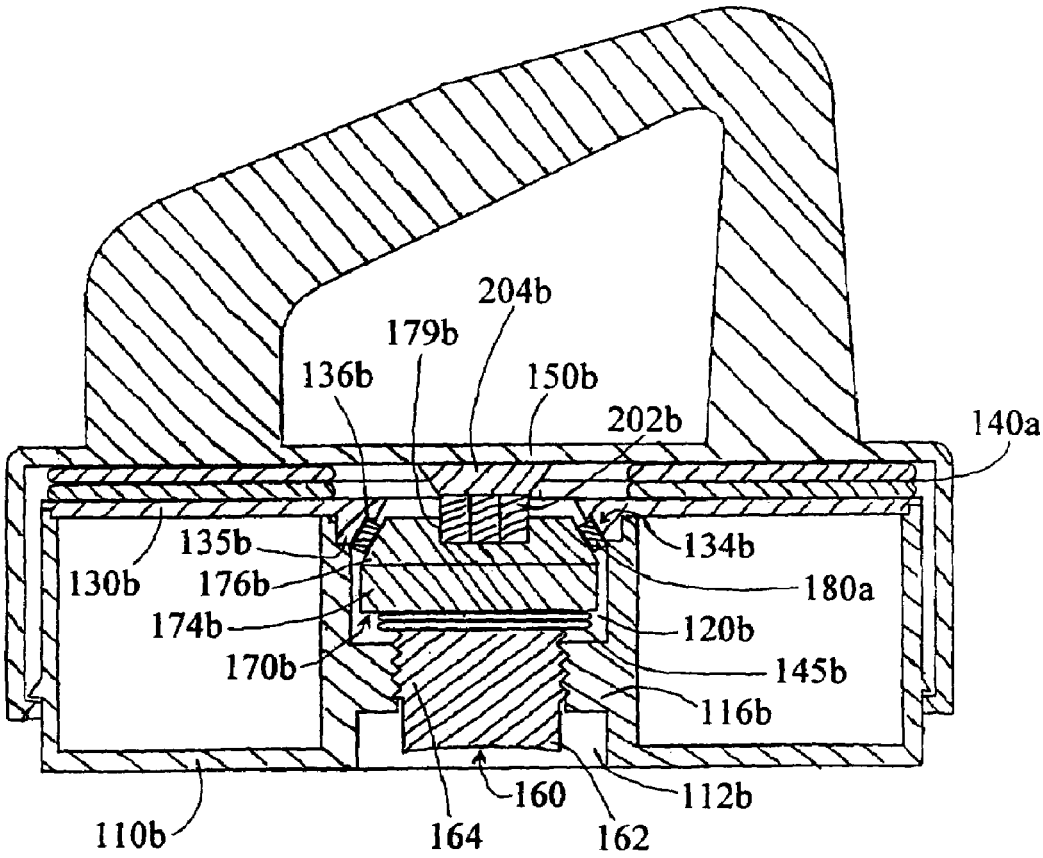
Figure 5D:
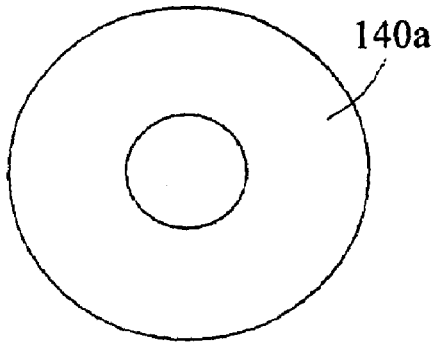
Figure 5E:
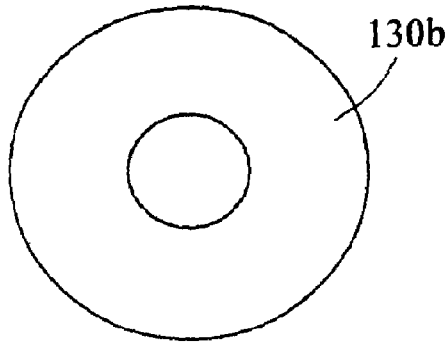
Figure 5F:
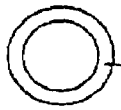
Figure 5J:
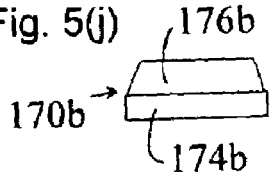
Figure 5G:
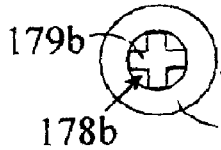
Figure 5K:
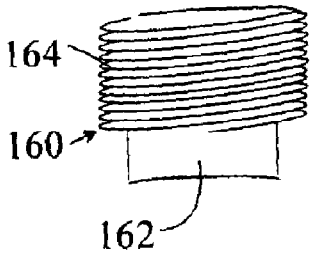
Figure 5H:
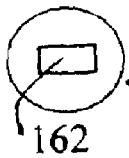
Figure 5I:
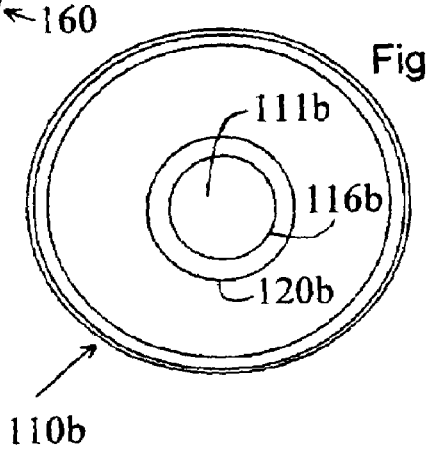

FIGS. 5(*a*)-(*k*) depict another embodiment of the resistance components. FIGS. 5(*a*) and (*c*) illustrate bottom view of the upper housing and lower housing cap, respectively. FIG. 5(*b*) illustrates a cross-section of this embodiment. FIGS. 5(*d*)-(*g*) and (*i*) illustrate top views of various components. FIG. 5(*h*) depicts a bottom view of the adjustment mechanism. FIGS. 5(*j*)-(*k*) illustrate side views of components.

Figures 6A, 6C, 6D, 6E, 6F, 6G, 6H, 6I, 6J, 6K, 6L, 6M:
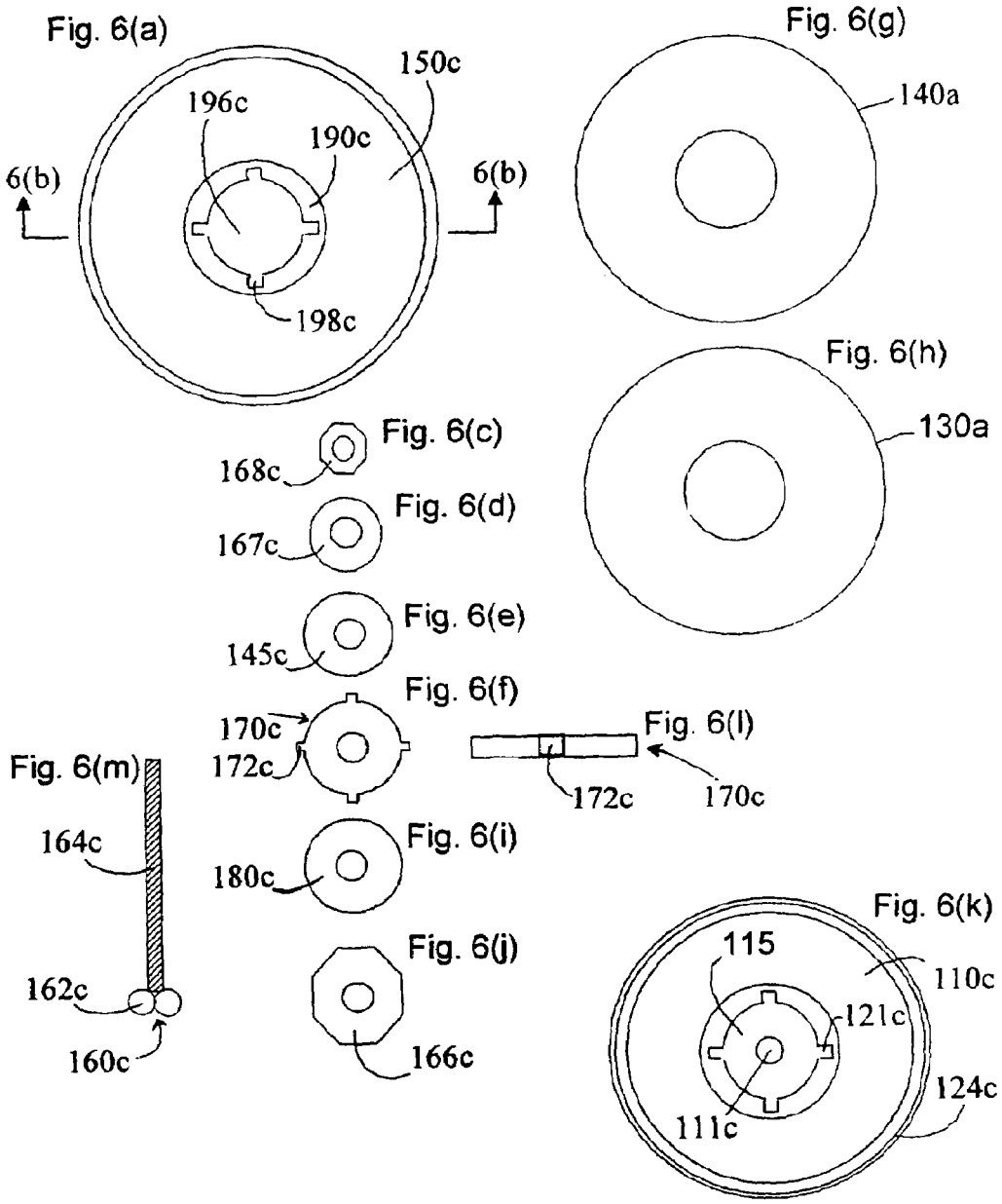
Figure 6:
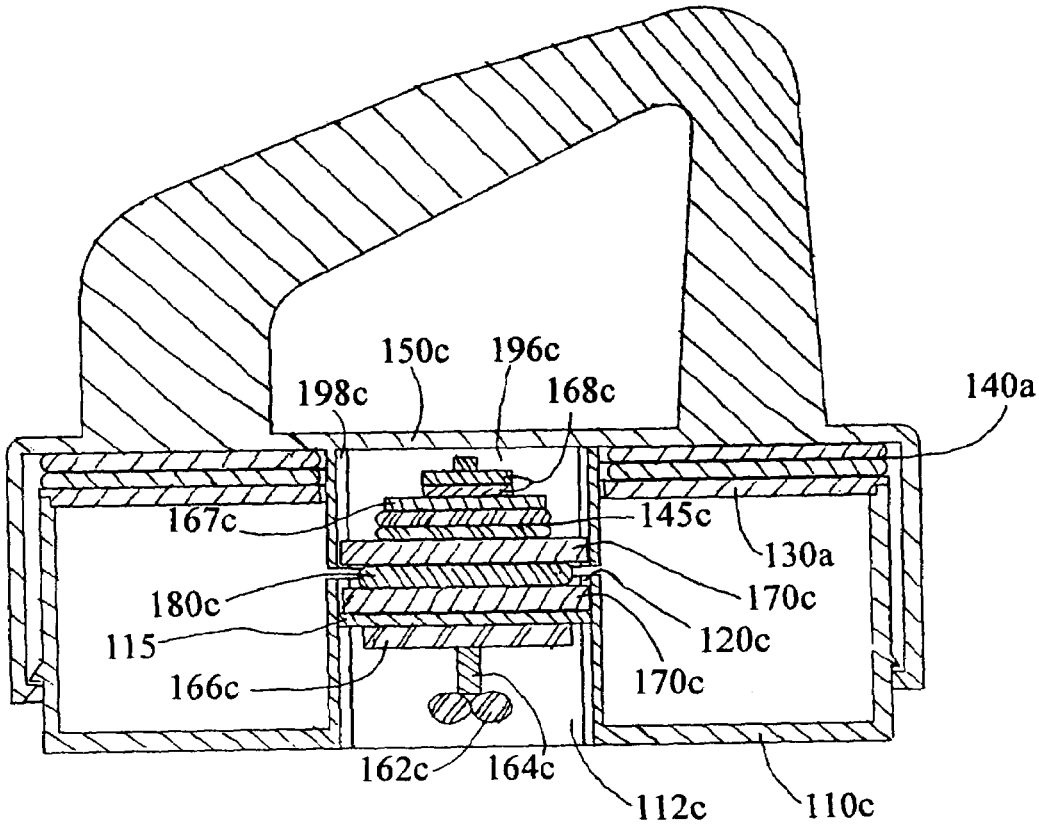
Figure 6:
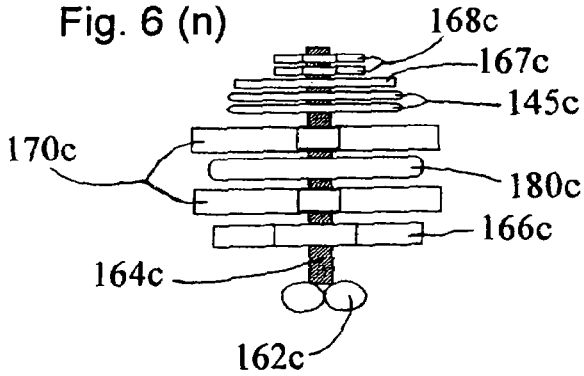

FIGS. 6(*a*)-(*n*) illustrate another embodiment of the invention. FIG. 6(*a*) depicts a bottom view of the upper housing. FIG. 6(*b*) illustrates a cross-section. FIGS. 6(*g*)-(*k*) illustrate top views of various components. FIGS. 6(*l*) and (*m*) depict side views of components. FIG. 6(*n*) illustrates components spaced out along the threaded bolt.

Figure 7A:
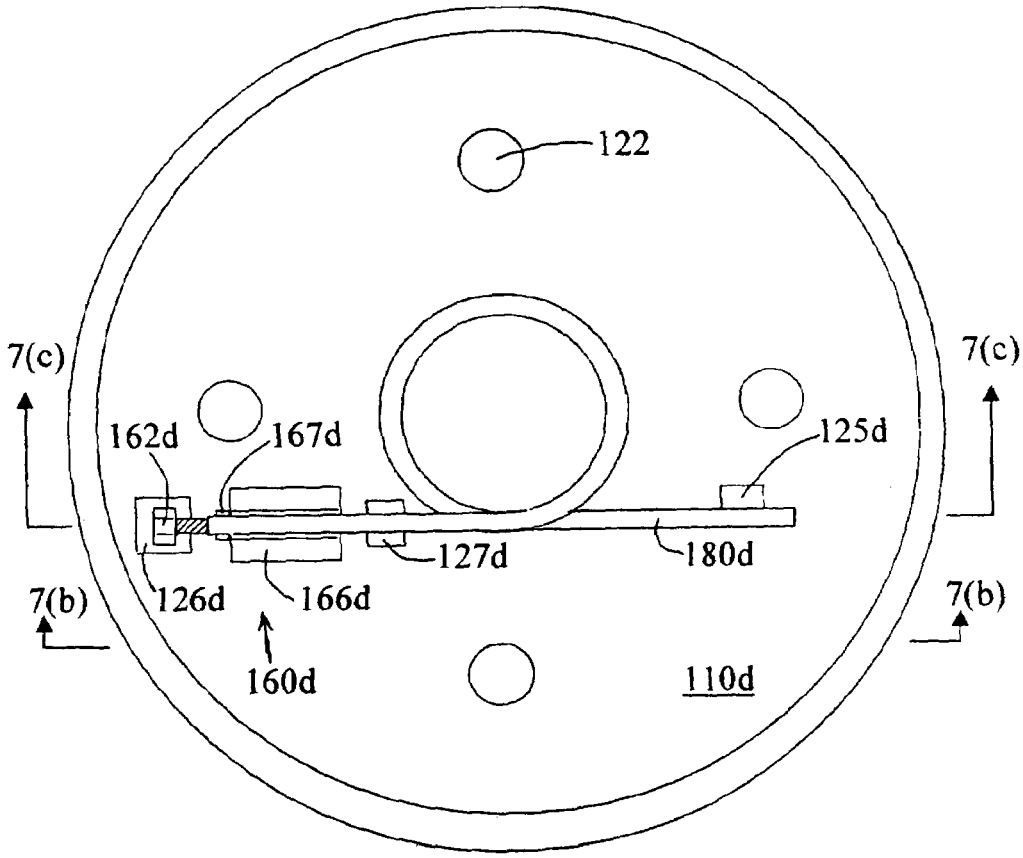
Figure 7C:
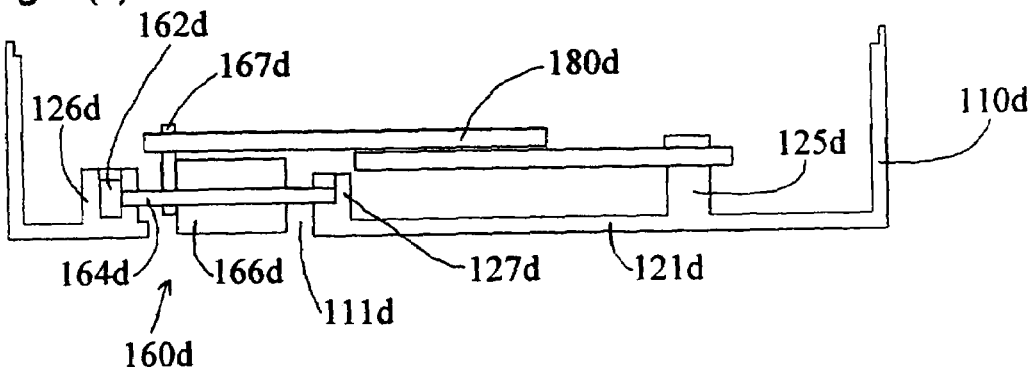
Figure 7:
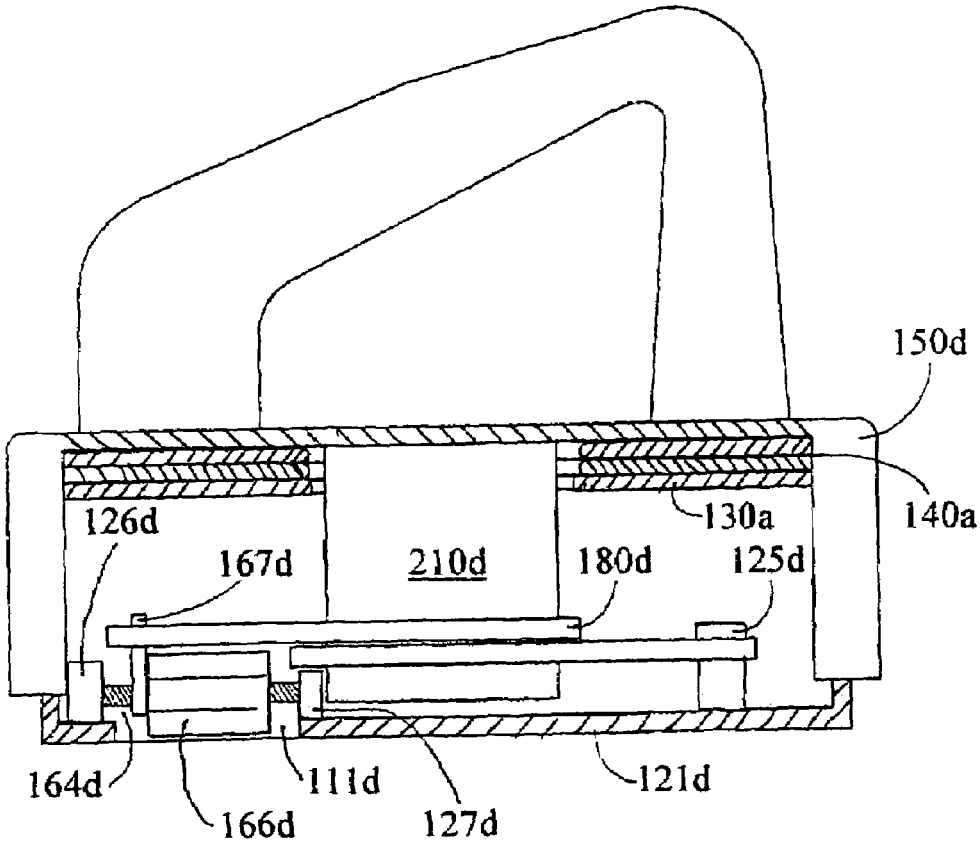
Figure 7:
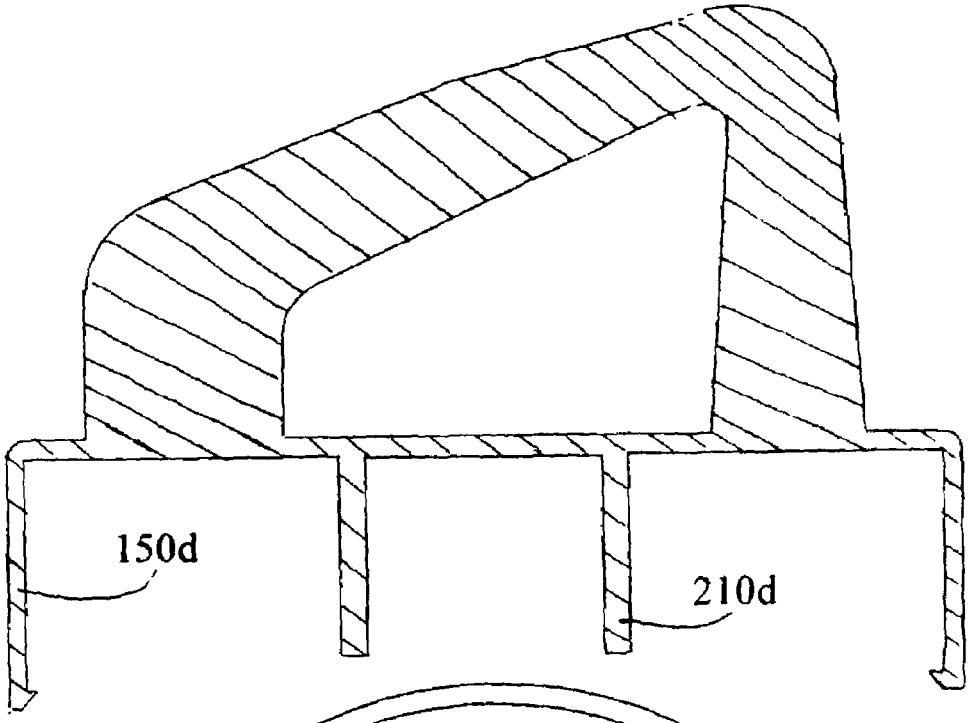
Figure 7:
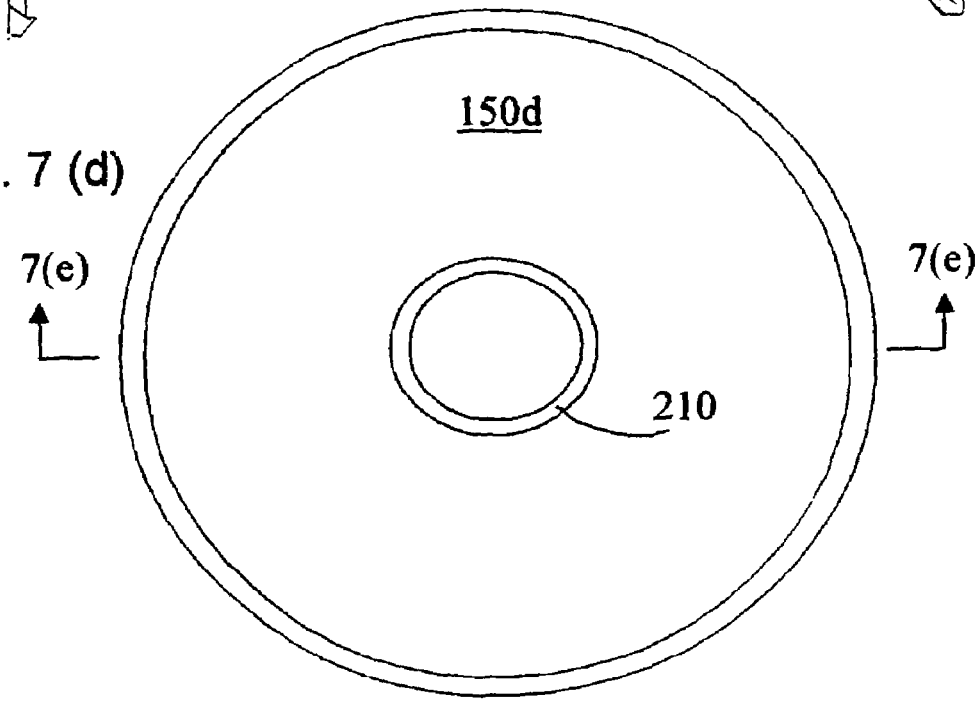

FIGS. 7(*a*)-(*e*) depict another embodiment of the invention. FIG. 7(*a*) illustrates a top view of the lower housing and resistance components, and for exemplary purposes illustrates the supporting posts. FIG. 7(*b*) depicts a cross-section of the invention. FIG. 7(*c*) illustrates a cross-section taken at 7(*c*)-7(*c*) of FIG. 7(*a*). FIG. 7(*d*) depicts a bottom view of the upper housing. FIG. 7(*e*) illustrates a cross-section of the upper housing.

Figure 8B:
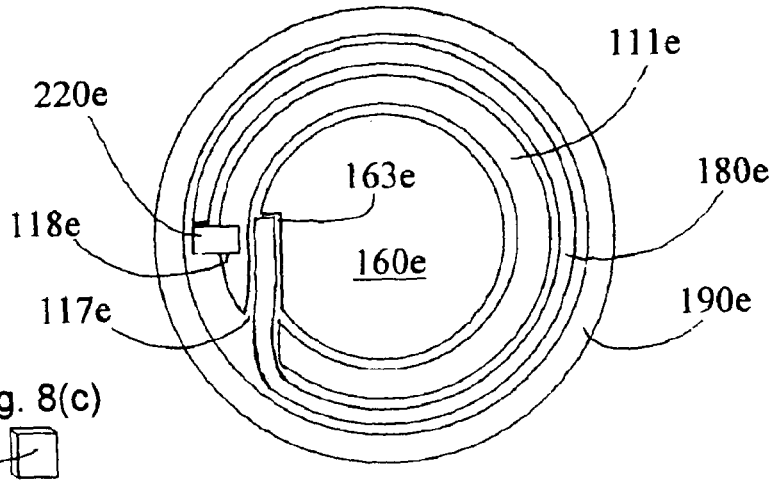
Figure 8C:
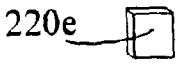
Figure 8D:
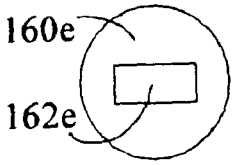
Figure 8E:
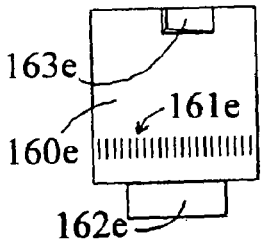
Figure 8F:
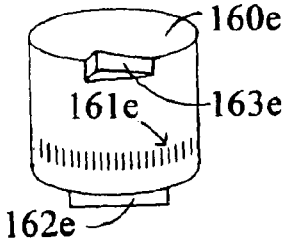
Figure 8G:
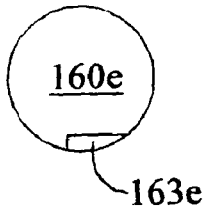
Figure 8A:
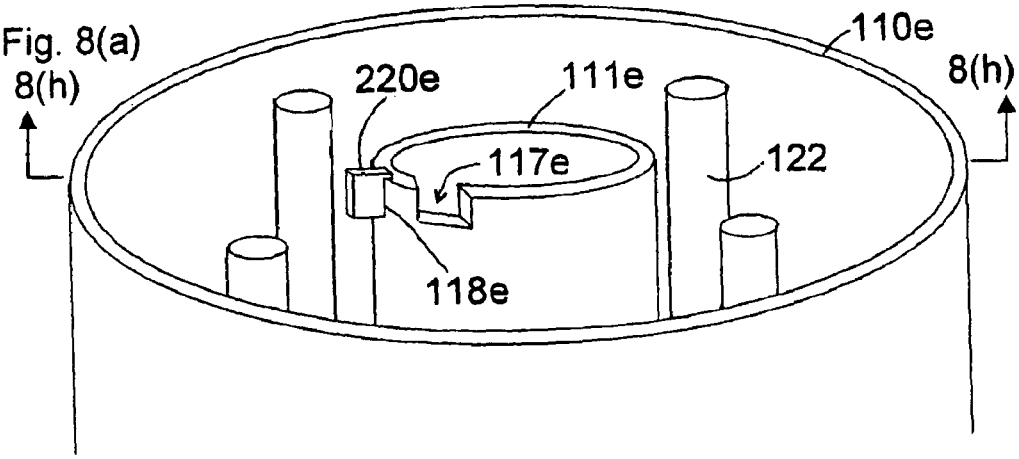
Figure 8:
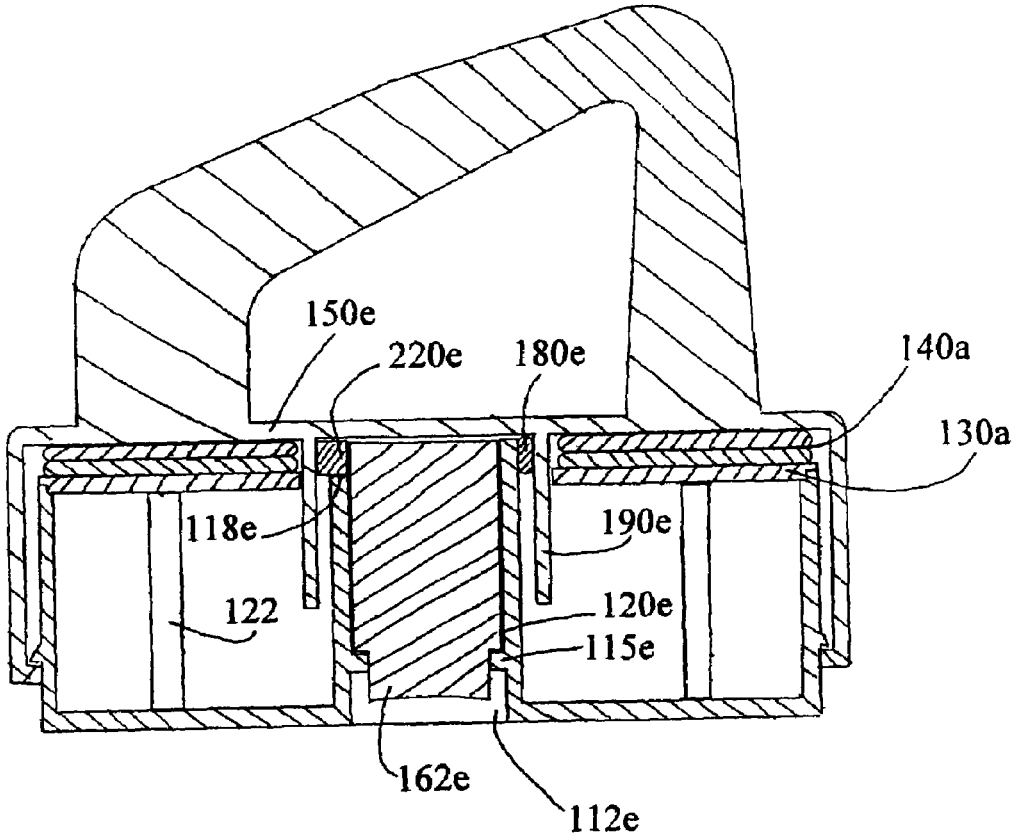

FIGS. 8(*a*)-(*h*) illustrates another embodiment of the invention. FIG. 8(*a*) depicts an angled view of the lower housing with supporting posts. FIG. 8(*b*) illustrates a top view of the dial, central passageway, nesting unit, friction material, and block. FIG. 8(*c*) depicts a perspective view of the block. FIGS. 8(*d*)-(*g*) illustrate different views of the dial. FIG. 8(*h*) illustrates a cross-section of this embodiment.

Figure 9C:
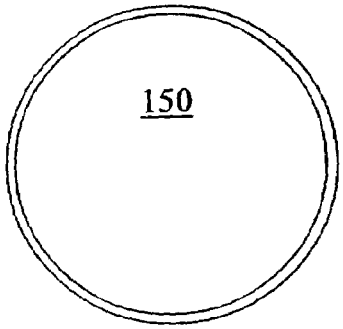
Figure 9D:
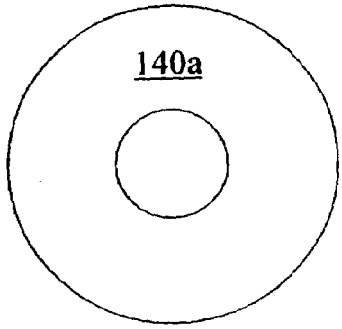
Figure 9E:
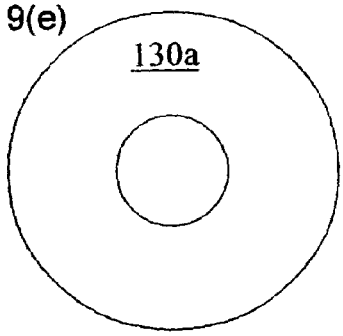
Figure 9I:
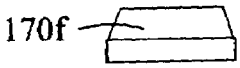
Figure 9F:
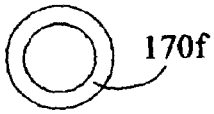
Figure 9J:
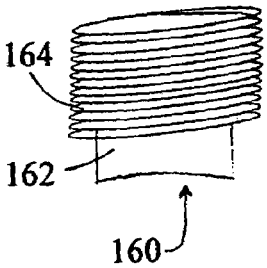
Figure 9G:
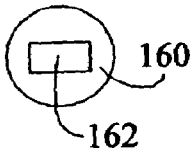
Figure 9H:
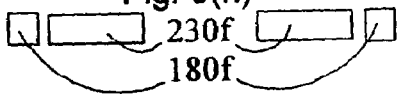
Figure 9A:
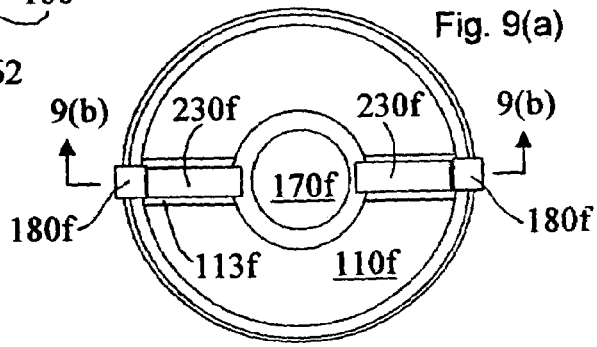
Figure 9:
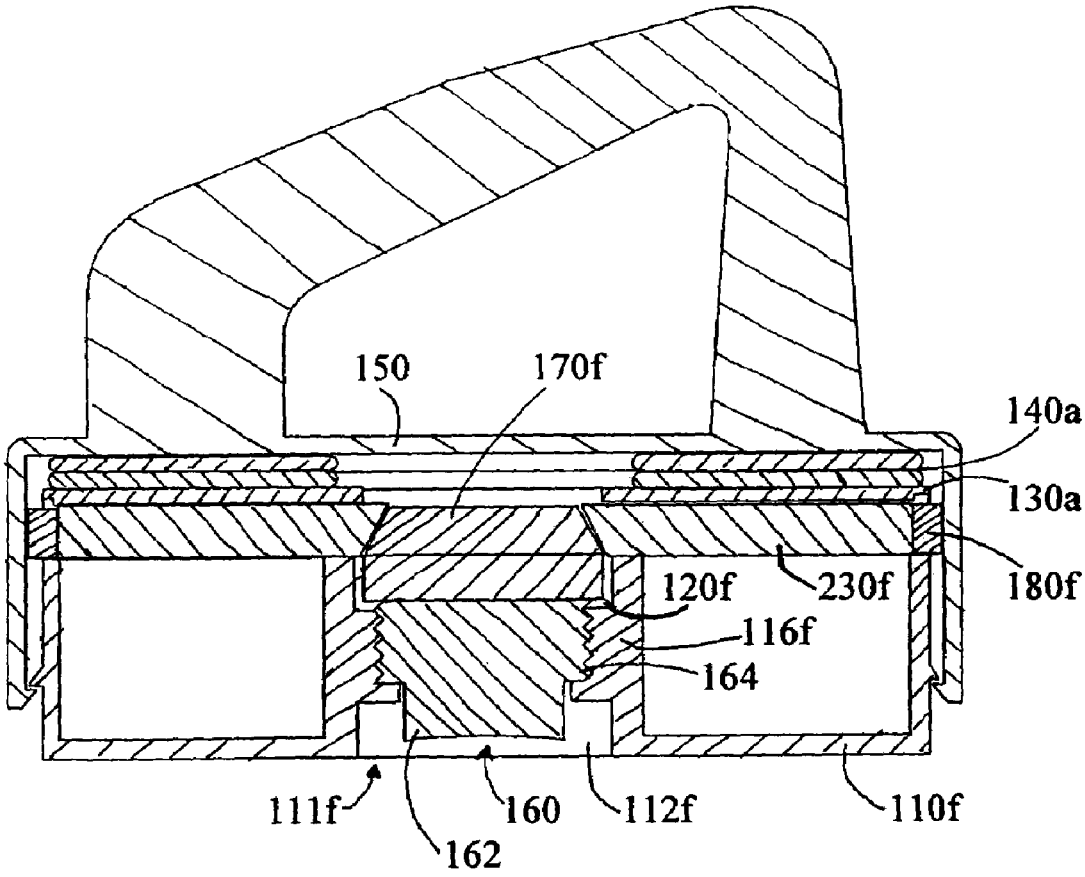

FIGS. 9(*a*)-(*j*) illustrate another embodiment of this invention. FIG. 9(*a*) illustrate a top view of the lower housing, push bars, friction material, and compression component. FIG. 9(*b*) depicts a cross-section of this embodiment. FIGS. 9(*c*)-(*f*) illustrate top views of different components. FIG. 9(*g*) depicts a bottom view of the adjustment mechanism. FIG. 9(*h*) depicts the push bars and friction material. FIGS. 9(*i*)-(*j*) illustrate side views of components.

Figure 10:
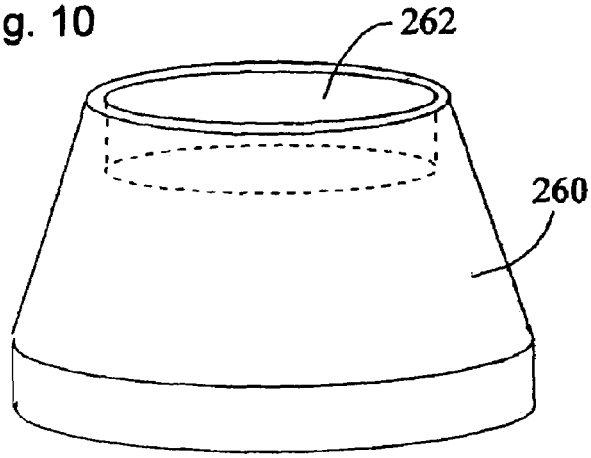

FIG. 10 depicts an accessory for use with the invention.

Figure 11A:
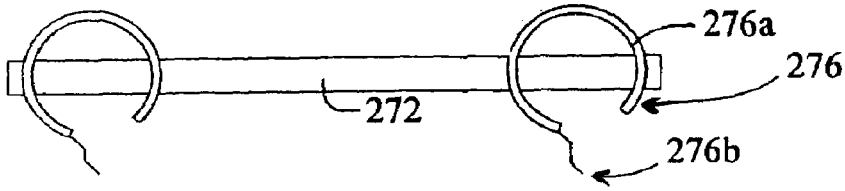
Figure 11B:
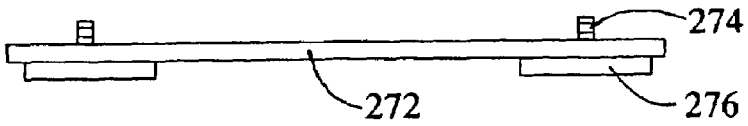
Figure 11C:
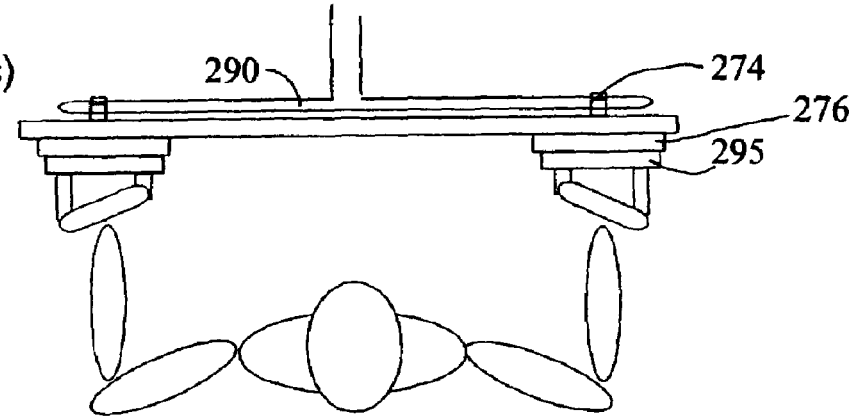

FIGS. 11(*a*)-(*c*) illustrate another accessory for use with the invention.

V. DETAILED DESCRIPTION OF THE INVENTION

The invention will now be described with reference to the drawings, wherein like reference characters designate like or corresponding parts throughout the figures.

The invention is an exercise apparatus to assist in performing push-ups by providing an ergonomic grip for proper wrist and arm alignment, and a rotation of the hands and arms. The device will allow the rotation of the hands/arms to the floor from zero degrees to potentially 360 plus degrees with as little or as much resistance as the user selects for the device to provide.

The base embodiment of the invention preferably includes the following elements: a footing 100, a lower housing (or base) 110, a lower housing cap 130, a non-mechanical bearing element 140, and an upper housing (or cover or platform) 150 as shown in FIGS. 1(*a*)-2(*b*). FIGS. 3(*a*)-(*c*) are also illustrative if the stopper structure is ignored. The lower housing 110 and the upper housing 150 rotate relative to each other preferably through the bearing element 140.

The upper housing 150 preferably shrouds and covers the other components and protects them from foreign elements such as sweat from the user. Preferably the upper housing 150 has an internal rim 154 around its inner cavity to engage a corresponding rim 124 around the outside wall 123 of the lower housing 110 to nest the lower housing 110 within the upper housing 150 as shown in FIG. 1(*b*). The rim 154 of the upper housing 150 preferably slides over the rim 124 of the lower housing 110 to couple and secure the upper housing 150 and the lower housing 110 together. The preferred material for constructing the upper housing 150 and the lower housing 110 is a rigid polymer formed using injection or rotational molding. One of ordinary skill in the art will appreciate that the upper housing 150 and the lower housing 110 may be manufactured out of metal including stainless steel and aluminum, or any other rigid material.

The lower housing 110 preferably is cylindrical; however, the lower housing may be a variety of shapes as long as there is sufficient surface upon which the upper housing 150 may rotate. The lower housing 110 preferably also includes a flat horizontal bottom surface 121.

Preferably the lower housing 110 is attached to a footing 100. The footing 100 preferably is a non-slip/gripping material positionally stabilizing the exercise apparatus on the underlying surface to minimize sliding created by horizontally directed force vectors, for example, rubber. The footing 100 has a shape to correspond to the bottom surface 121 of the lower housing 110. The footing 100 may also be a plurality of small pieces spread out over the bottom surface of the lower housing. One of ordinary skill in the art will realize that the bottom surface of the lower housing can be designed in such a manner to provide sufficient friction with a non-slippery surface instead of attaching the footing 100.

A lower housing cap (or lid) 130 covers the lower housing 110 and provides an operation surface for the bearing element 140. The lower housing cap 130 fits over the lower housing 110 to provide a flat surface preferably in a circular shape, but may be of any appropriate configuration, e.g., elliptical, oval, etc. to match the horizontal cross-section of the lower housing. The lower housing cap 130 preferably has a cross-sectional shape corresponding to that of the lower housing 110 to better facilitate the upper housing 150 fitting over the combined lower housing 110 and lower housing cap 130. The lower housing cap may be a solid disc 130 (shown in FIG. 1(*b*)) or donut shape 130' (shown in FIG. 3(*b*)) as long as sufficient surface area is provided for the bearing element 140 to rest on upon assembly of the apparatus.

The lower housing cap 130 preferably is made of the same type of material as the lower housing 110. As one of ordinary skill in the art will appreciate, the lower housing cap 130 and lower housing 110 may be manufactured as one (unitary) piece. To increase the strength of the lower housing and lower housing cap, an internal weight distributing system 122 such as support posts, skeleton structure or a solid lower housing will assist in distributing the weight of the user that is placed on and transferred down from the upper housing 150. Examples of weight distributing systems are shown for exemplary purposes only in FIGS. 7(*a*), 8(*a*), and 8(*h*) as 122. The embodiments represented in these FIGs. do not require the use of a weight distributing system to function.

In accordance with an aspect of the invention, the non-mechanical bearing element may be disposed between the top of the lower housing cap and the upper surface of the inside cavity of the upper housing as shown for example in FIG. 1(*b*). The bearing element facilitates the rotation of the upper housing relative to the lower housing. The bearing element preferably is a pair of washers 140' (shown in FIG. 3(*b*)) or discs 140 (shown in FIG. 1(*b*)), which due to the material properties, will provide more freedom of rotation than is possible with just one washer or disc. The two discs of the bearing will rotate relative to each other quite freely while remaining relatively static to the pieces abutting or adjacent to the bearing. The bearing element preferably is made from Teflon or other similar non-friction (or low friction) material. One of ordinary skill in the art will appreciate an equivalent structure for the bearing element may be realized wherein the lower housing cap and the upper surface of the inside cavity of the upper housing may be coated with Teflon or other similar non-friction (or low friction) material thus eliminating a separate piece for the bearing element. Preferably each of the discs used for the bearing element may have a thickness up to and including 0.20 inches thick, more preferably within a range of 0.05 to 0.15 inches thick, and most preferably in the range of 0.0625 to 0.125 inches where the end points of each range are included within the range.

Preferably a handle 152 extends from the upper housing 150 as shown in FIGS. 1(*a*)-(*c*). The handle 152 extending from the upper housing 150 preferably includes two upright portions connected by a gripping area. The two upright portions 160, 162 are of different heights to place the gripping area 164 at an angle to the plane of the upper housing area. The two upright portions 160, 162 preferably have different diameters to match the diameter of the respective end of the gripping area 164. The lower end of the gripping area 164 is preferably positioned at an angle of about 14 degrees from the horizontal plane. The gripping area 164 is tapered in a conical shape to better fit within a user's hand as shown in FIGS. 1(*c*). The taper of the gripping area 164 provides a better fit within the palm of the user's hand because of the natural taper that exists within a partially or completely closed hand from the pointer finger to the pinkie finger of the hand. The gripping area 164 preferably has an arch 166 near the center of the top surface of the handle 152. The arch, which extends outside of the tapering envelope, accommodates the slight valley that exists within the palm of the hand.

The handle 152 may be manufactured from a rigid material, preferably a polymer or metal. The gripping area of the handle may further include foam, rubber, polypropylene, polyvinyl chloride, silicones, or thermoplastics that encases the rigid polymer or the metal. More preferably, the gripping area of the handle may be manufactured from foam or rubber that encases the rigid polymer or the metal.

The handle 152 preferably is integrally formed with the upper housing 150 as one piece. The handle 152, if made as a separate piece that is attached to the upper housing 150, may be attached using an adhesive like epoxy or mechanical means like screw or bolts.

The gripping area may be modified to include finger grips primarily along the lower surface of the gripping area while still maintaining the general taper nature of the handle.

The invention may include a punch (or fist) or similar pad 152' in place of the handle as shown in FIG. 2(*b*). The punch pad 152' is similar to the pads that are commonly found on weight machines and are well known in the art. The punch pad 152' is of sufficient thickness to provide padding for a clinched fist to stand in or rest in while performing push-ups when utilizing this invention. The punch pad 152' helps cradle the fist while simultaneously strengthening the skin surfaces on the impact face of the fist. The punch pad when used recreates the motion and positioning of the most critical muscles utilized while executing the punching motion and therefore increases the effectiveness of the activity while simultaneously decreasing the chance for injury. The punch pad 152' also assists in developing the muscles utilized in the execution of a punch such as muscles located, for example, in the hand, the wrist, the arm and the shoulder of the user. The punch pad 152' also allows the user to perform push-ups on his/her fingertips using the apparatus as support for the palm area of the hand. The punch pad 152' preferably is attached to the upper housing with an adhesive like epoxy.

The base embodiment provides the common building blocks for the remaining embodiments.

The next embodiment, as shown in FIGS. 3(*a*)-(*c*), includes the footing 100, the lower housing 110', the lower housing cap 130', the bearing element 140', and the upper housing 150' of the base embodiment of this invention. This embodiment furthers includes a stopper 156'.

The lower housing 110' further includes at least one opening 128' on its wall 123' above the rim 124' around its periphery. The lower housing 110' preferably has a solid bottom. The lower housing cap 130 and the bearing element 140 are preferably both solid discs as shown in FIG. 1(*b*), but may be donut shaped as shown in FIG. 3(*b*). The upper housing 150' may have an opening 151' passing through its wall.

The stopper 156' may be any item that is capable of engaging the opening 128', 151' in both the lower housing and the upper housing to prevent the upper housing from rotating with respect to the lower housing. Preferably the stopper 156' is a rubber or metal plug. For added convenience the stopper 156' may be attached to the apparatus with a string or other similar attachment means to assist in preventing the stopper from being lost.

The stopper may also be a push button attached to the upper housing for engaging an opening in the lower housing. The push button mechanism may be one of the many different types of push button mechanisms known to one of ordinary skill in the art.

One of ordinary skill in the art will appreciate that this embodiment may be modified to provide a consistent amount of friction by locating friction material around the outside of the lower housing wall above the rim to provide a level of resistance for the apparatus above the nominal resistance present in the apparatus. The friction material would have an opening corresponding to each opening present in the lower housing.

The next embodiment of this invention modifies the base embodiment to include regulating components to provide the individual a way to adjust the amount of internal resistance provided by the apparatus to rotating the upper housing relative to the lower housing. The regulating components include a combination of friction material, a compression component, and an adjustment mechanism. The friction material, the compression component, and the adjustment mechanism provide a reliable form of adjustable resistance to rotation between the lower housing and the upper housing. The adjustment capability provided by the regulating components allows the user to change the resistance level from no resistance to a point of complete-locked resistance.

The friction material preferably is made from a sturdy, flexible material capable of providing resistance and friction between two pieces, for example, rubber or leather. Leather meets these friction requirements, and leather has proven to be extremely reliable in providing excellent longevity and performance in similar friction load applications. To increase the level of friction between the upper housing and the lower housing, the surfaces which contact the friction material can include friction enhancing surface irregularities such as scuffing and/or small protrusions to increase the level of friction between the friction material and the rotating parts. When so roughened, it is important to consider in selecting a material that resists undue wear which otherwise would undermine the durability of the friction material.

Preferably the regulating components are made from the same materials as the material used to make the upper housing and the lower housing, i.e., metal or plastic.

With the inclusion of the regulating components, the lower housing, the lower housing cap and the bearing element receive common modifications that are present in each embodiment of the invention with regulating components. The lower housing includes a hole in its base for the adjustment mechanism to pass through and/or be accessed through. In most cases the hole will be one end of a central passageway that has a predominately circular cross-section in the horizontal plane. Depending on the particular embodiment of the regulating components, the central passageway will have sections with different internal diameters. Different embodiments of the regulating components will require that key (or locking) channels extending radially out from the central passageway, for example, the keyway channels 121*a* extending out from central passageway, for example 111*a* in FIG. 4(*h*).

The lower housing cap includes an opening with the same or larger diameter than the diameter at the top of the central passageway if one is present in the lower housing. If the central passageway includes keyway channels, then the opening diameter in the lower housing cap will be sufficiently large to provide access from the top of the lower housing to pass the regulating components through the lower housing cap into the central passageway. The bearing element preferably is the same horizontal shape as the lower housing cap and includes an opening with at least the diameter of the opening in the lower housing.

The regulating components and internal housing cavities are appropriately sized to accommodate the possible wear factor of the friction material and still provide the necessary resistance.

One of ordinary skill in the art will appreciate that the regulating components embodiment may be modified to include the stopper elements previously described.

One of ordinary skill in the art will appreciate that the following discussion regarding the elements utilized in the following embodiments is for exemplary purposes. The various embodiments each have the footing 100, the lower housing, the lower housing cap, the bearing element, the regulating components, and the upper housing just described with any variant of these parts discussed. One of ordinary skill in the art based on the discussion above will appreciate that although the drawings show a handle in connection with the various embodiments that a punch pad may replace the handle, and some FIGs. illustrate a weight bearing system that may be utilized in any of the embodiments but is not required.

The preferred regulating components are shown in FIG. 4(*a*)-(*j*). The regulating components in this embodiment are a single compression friction resistance apparatus. This embodiment includes the footing 100, the lower housing 110*a*, the adjustment device 160, the compression component 170*a*, the friction material 180*a*, the lower housing cap 130*a*, the bearing element 140*a*, and the upper housing 150*a*.

The lower housing 110*a* includes a central passageway 111*a* with three sections 112*a*, 116*a*, 120*a*. The first section 112*a* is of sufficient diameter to allow the user to turn the adjustment device 160. The second (or threaded) section 116*a* is threaded to hold the adjustment device 160 in place during use. One of ordinary skill in the art will readily realize that the second section 116*a* can subsume the first section 112*a*. The third (or locking) section 120*a* preferably is smooth and includes four keyway channels 121*a* extending radially outward from the central passageway 111*a*. The keyway channels 121*a* are for engaging the compression component 170*a*. The circular diameter of the third section preferably is slightly larger in diameter than the second section to provide a shoulder between the two sections.

The lower housing cap 130*a* rests on the outer edges of the lower housing 110*a* and the upper edge of the central passageway 111*a*. The bearing element 140*a* rests on the lower housing cap 130*a*. Both the lower housing cap 130*a* and the bearing element 140*a* have a central opening 132*a*, 142*a* passing through each of them that preferably is aligned with the central passageway 111*a*.

The adjustment device 160 preferably is a screw mechanism 164 with a turning handle 162, which can be of any shape easily grasped and turned by an individual not just the rectangular box shape depicted in the drawings. Preferably the screw mechanism 164 and turning handle 162 are a unitary piece. The compression component 170*a* includes a base portion 174*a* and an upper portion 176*a*. The base portion 174*a* is cylindrical with four square guide keys 172*a* extending radially from the periphery to individually engage a respective key channel 121*a* of the central passageway 111*a*. The upper portion 176*a* is tapered inwardly from the base portion 174*a* to the top of the upper portion. The adjustment device 160 and the compression component 170*a* may be formed as one piece (e.g., unitary).

The friction material 180*a* preferably is donut shape or a ring to fit around the upper portion 176*a* of the compression component 170*a*.

The upper housing 150*a* includes a nesting unit 190*a* for mating with the friction material 180*a*. The nesting unit 190*a* extends down from the top of the inside cavity of the upper housing 150*a*. The nesting unit 190*a* includes an outside perimeter wall 192*a*, an inner circular wall 194*a*, and a central recess area 196*a*. The inner wall 194*a* preferably extends down a shorter distance from the upper housing than the outer wall 192*a*. The friction material 180*a* nests in a groove 193*a* formed between the outside wall 192*a* and the inner wall 194*a*. The upper portion 176*a* of the compression component 170*a* is receivable into the recess area 196*a*.

The user can adjust the amount of rotational resistance of the device by rotating the adjustment device 160 using the turning handle 162. As the adjustment device 160 is turned, the screw mechanism 164 moves relative to the threaded section 116*a* of the central passageway 111*a* and moves the compression component 170*a* in the vertical direction. If the adjustment device 160 is turned clockwise, then the compression component 170*a* moves upwards forcing the friction material 180*a* to compress against the groove 193*a* formed by the inner and outer walls 192*a*, 194*a* of the nesting unit 190*a*. With increased compression of the friction material 180*a*, the rotational resistance is increased between the upper housing 150*a* and the compression component 170*a*, which engages the lower housing 110*a*. If the adjustment device 160 is turned counterclockwise, there will be less compression of the friction material 180*a* between the compression component 170*a* and the nesting unit 190*a*, and thus less resistance.

Another embodiment of the regulating components is shown in FIG. 5(*a*)-(*k*). The regulating components in this embodiment are an upper connecting shaft compression friction resistance apparatus. This embodiment includes the footing 100, the lower housing 110*b*, the adjustment device 160, the compression component 170*b*, the friction material 180*a*, the lower housing cap 130*b*, first and second bearing element 140*a*, 145*b*, and the upper housing 150*b*.

The lower housing 110*b* includes a central passageway 111*b* with three sections 112*b*, 116*b*, 120*b*. The first section 112*b* is of sufficient diameter to allow the user to turn the adjustment device 160. The second (or threaded) section 116*b* is threaded to hold the adjustment device 160 in place during use. One of ordinary skill in the art will readily realize that the second section 116*b* can subsume the first section 112*b*. The third (or rotating) section 120*b* preferably is smooth.

The lower housing cap 130*b* rests on the outer edges of the lower housing 110*b* and the upper edge of the central passageway 111*b*. The lower housing cap 130*b* preferably includes a mating area 134*b* with a similar structure to that present in the previous embodiment as part of the nesting unit 190*a* of the upper housing except the recess is an opening. The friction material 180*a* nests in a groove 136*b* formed by the outside wall 135*b*, which aligns with the central passageway 111*b*. The mating section 134*b* abuts the third section 120*b* of the central passageway 111*b*. This design reduces the expense of manufacturing when the lower housing and the lower housing cap are made from a rigid polymer.

The first bearing element 140*a* rests on the lower housing cap 130*b*. The first bearing element is the bearing element previously discussed. Both the lower housing cap 130*b* and the first bearing element 140*a* have a central opening passing through each of them.

The adjustment device 160 preferably is a screw mechanism 164 with a turning handle 162. Preferably the screw mechanism 164 and turning handle 162 are a unitary piece. The compression component 170*b* includes a base portion 174*b* and an upper portion 176*b*. The base portion 174*b* is cylindrical, and may be eliminated to decrease the overall height of the device. The upper portion 176*b* is tapered inwardly from the base portion 174*b* to the top of the upper portion 176*b*. A recess or cavity 178*b* is formed as an indention into the top surface of the upper portion 174*b* to engage the upper housing 150*b*. The recess 178*b* is shape such that when engaged by the upper housing 150*b*, the compression component 170*b* will rotate with the upper housing 150*b*. The recess 178*b* preferably includes four keyway channels 179*b* that extend away from each other to form a "X" or a cross.

Between the adjustment device 160 and the compression component 170*b* is the second bearing element 145*b*, which allows the adjustment device 160 and the compression component 170*b* to freely rotate to each other. The second bearing element 145*b* preferably is a pair of washers or discs to provide more freedom of rotation than is possible than with just one washer or disc. The use of two washers or discs allows for them to rotate to each other and remain relatively static as compared to the adjustment device 160 and compression component 170*b*, respectively. As discussed above in connection with the common bearing element, the second bearing element may be a coating on the top surface of the adjustment device and a coating on the bottom surface of the compression component.

The upper housing 150*b* includes a column 200*b* for engaging the recess 179*b* in the compression component 170*b*. The column 200*b* extends down from the top of the inside cavity of the upper housing 150*b*. The column 200*b* preferably includes four guide keys 202*b* that extend away from each other to form a "X" or a cross, i.e., a shape that corresponds to the recess in the compression component. The column 200*b* nests within the recess 179*b* of the compression component 170*b* to have the upper housing 150*b* and compression component 170*b* rotate in unison.

The column, as shown in FIGS. 5(*a*)-(*b*), to increase the strength of the upper housing and withstand the rotational forces may include a taper upper portion 204*b* that has a larger diameter adjacent to the top of the inner cavity than the diameter adjacent the four guide keys 202*b*. With this design the guide keys can either extend the full height of the column (not shown), blend into the tapered portion while maintaining their walls at the same radial distance from the center of the column throughout their vertical distance (not shown), or the taper upper portion 204*b* has a lower diameter corresponding to the length across two opposing guide keys 202*b* (as shown).

The user can adjust the amount of rotational resistance of the device by rotating the adjustment device 160 using the turning handle 162. As the adjustment device 160 is turned, the screw mechanism 164 moves relative to the threaded section 116*b* of the central passageway 111*b* and moves both the second bearing element 145*b* and the compression component 170*b* in the vertical direction. If the adjustment device 160 is turned clockwise, then the compression component 170*b* moves upwards forcing the friction material 180*a* to compress against the groove of the mating section 134*b* of the lower housing cap 130*b*. With increase compression of the friction material 180*a*, the rotational resistance is increased between the compression component 170*b*, which engages the upper housing 150*b*, and the lower housing 110*b* via the lower housing cap 130*b*. If the adjustment device 160 is turned counterclockwise, there will be less compression of the friction material 180*a* between the compression component 170*b* and the mating section 134*b* of the lower housing cap 130*b*.

A modification to this embodiment is that the lower housing 110*b* includes the mating section 134*b* of the lower housing cap 130*b*. This modification utilizes the lower housing cap as described in connection with the previous embodiment.

Another embodiment of the regulating components is shown in FIG. 6(*a*)-(*n*). The regulating components in this embodiment are a dual compression friction resistance apparatus. This embodiment includes the footing 100, the lower housing 110*c*, the adjustment device 160*c*, first and second compression component 170*c*, the friction material 180*c*, the lower housing cap 130*a*, first and second bearing element 140*a*, 145*c*, and the upper housing 150*c*.

The lower housing 110*c* includes a central passageway 111*c* with two sections 112*c*, 120*c*. The first section 112*c* is of sufficient diameter to allow the user to turn the adjustment device 160*c*. The second (or locking) section 120*c* preferably is a larger diameter than the first section. The junction between the first and second sections 112*c*, 120*c* preferably forms a shelf 115 for the first compression component 170*c* to sit and rest upon. As one of ordinary skill in the art will appreciate, the shelf 115 may extend across the opening of the first section 112*c* to the extent that the opening through the shelf 115 is sufficiently large enough to allow the adjustment device 160*c* to pass therethrough. The height of the second section 120*c* preferably is not greater than the combined height of the first compression component 170*c* and the friction material 180*c*.

The lower housing cap 130*a* rests on the outer edges of the lower housing 110*c*. There is a sufficient space between the top of the central passageway 111*c* and the lower housing cap 130*c* to allow a nesting unit 190*c* from the upper housing 150*c* to extend into the lower housing 110*c*. The first bearing element 140*a* rests on the lower housing cap 130*a* and is the common bearing element previously discussed. Both the lower housing cap 130*a* and the first bearing element 140*a* have a central opening passing through each of them.

The adjustment device 160*c* preferably includes a nut 166*c*, a screw mechanism 162*c*, 164*c*, and a securing mechanism 167*c*, 168*c*. The screw mechanism preferably is a threaded stud 164*c* with a handle at the bottom end 162*c*. More preferably, the screw mechanism is a "T" handle ended threaded stud. The securing mechanism is placed on the end of the screw mechanism opposite the handle to secure the compression components 170*c*, the second bearing element 145*c*, and the friction material 180*c* along the threaded stud 164*c*. The securing mechanism preferably is one or some combination of the following: two nuts with or without adhesive like epoxy and a washer, one nut with adhesive and a washer, a nylock nut and a washer, a nut/washer combination with adhesive, or any other device which will withstand the torque and rotational forces applied by the second compression. The most preferable of these for the securing mechanism is the two nuts 168*c*, 168*c* with a washer 167*c*, which allows for the easiest manufacture of this embodiment.

The first and second compression components 170*c*, 170*c* preferably are flat. The first and second compression components preferably are unattached to the screw mechanism 164*c* and freely rotate independently of the screw mechanism. Each compression component 170*c*, 170*c* preferably is a stocky cylindrical unit with four guide keys 172*c* radially extending from the periphery of the cylindrical portion. The guide keys 172*c* preferably are square or other shape capable of locking into and engaging the keyway channels 121*c*, 198*c*, respectively, present in the lower housing 110*c* and upper housing 150*c*.

The second bearing element 145*c* preferably is free-floating and centered about the threaded portion 164*c* of the screw mechanism. The second bearing element 145*c* is located between the second compression component 170*c* and the washer 167*c* of the adjustment device 160*c*. The second bearing element 145*c* preferably is a pair of washers or discs to provide more freedom of rotation than is possible than with just one washer or disc. The use of two washers or discs allows for them to rotate to each other and remain relatively static as compared to the washer 167*c* and the second compression component 170*c*, respectively. As discussed above in connection with the common bearing element, the second bearing element may be a coating on the top surface of the adjustment device and a coating on the bottom surface of the compression component. The second bearing element allows the adjustment device 160*c* to rotate independently of the upper housing 150*c* and the second compression component 170*c*.

The upper housing 150*c* includes a nesting unit 190*c* for mating with the second compression component 170*c*. The nesting unit 190*c* extends down from the top of the inside cavity of the upper housing 150*c*. The nesting unit 190*c* includes a wall and a central recess area 196*c*. The central recess area 196*c* is predominately circular with keyway channels 198*c* radially extending into the wall from the periphery of the circular portion. The keyway channels 198*c* engage and receive the guide keys 172*c* of the second compression component 170*c*. The second compression component 170*c* and the second bearing element 145*c* nest within the central recess 196*c*.

The user can adjust the amount of rotational resistance of the device by holding the handle 162*c* of the screw mechanism and rotating the nut 166*c* to 1) apply or decrease pressure against the first compression component 170*c* and 2) change the distance between the nut 166*c* and the securing device 167*c*, 168*c* depending on the direction the nut 166*c* is turned. If the nut 166*c* is turned clockwise, then the first and second compression components 170*c*, 170*c* will be drawn together to sandwich the friction material 180*c*. As the amount of compression increases of the friction material 180*c*, the amount of friction increases and thus the rotational resistance increases between the first and second compression components 170*c*, 170*c*. The rotational resistance between the upper housing 150*c* and the lower housing 110*c* is related to the rotational resistance between the first and second compression components 170*c*, 170*c*, because the first and second compression components 170*c*, 170*c*, respectively, are engaged with the upper and lower housing 150*c*, 110*c*. If the adjustment device 160*c* is turned counterclockwise, there will be less compression of the friction material 180*c* between the first and second compression components 170*c*, 170*c* and thus between the upper and lower housings 150*c*, 110*c*.

A slight modification of this embodiment will allow the second section of the central passageway 120*c* and the first compression component 170*c* to be eliminated. The shelf 115 then is extended across the top of the first section with an opening of at least sufficient diameter for the threaded stud 164*c* to pass therethrough, and still provide sufficient compression forces as discussed above in connection with the first compression component 170*c*.

A further modification is to provide a threaded opening through the shelf 119*c* to engage the threaded stud 164*c*. Yet another modification is to have the shelf include a recess on its bottom surface to nest and lock in rotational place the nut 166*c* of the adjustment device 160*c*. The washer 170*c* then would apply the compression forces in conjunction with the shelf.

Another embodiment of the regulating components is shown in FIG. 7(*a*)-(*e*). The regulating components in this embodiment are a constricting belt friction resistance apparatus. This embodiment includes the footing 100, the lower housing 110*d*, the adjustment device 160*d*, the friction material 180*d*, the lower housing cap 130*a*, the bearing element 140*a*, and the upper housing 150*d*.

The lower housing 110*d* is a hollow cylinder and includes a slot 111*d* along its bottom surface 121*d*. The lower housing 110*d* includes a fastening post 125*d* for attaching to the friction material 180*d*. The lower housing 110*d* preferably includes two pieces 126*d*, 127*d* to position the adjustment device 160*d* over the slot 111*d*. The two pieces 126*d*, 127*d* preferably are within the internal cavity and aligned on opposite sides of the slot 111*d*.

The upper housing 150*d* includes a center shaft 210*d*. The center shaft 210*d* preferably is hollow but sufficiently thick to withstand the forces associated with the friction material 180*d* being wrapped around its outside circumference. The center shaft 210*d* passes through the lower housing cap 130*a* and the bearing material 140*a* into the internal cavity of the lower housing 110*d* to be wrapped with the friction material 180*d* preferably at least one time.

The lower housing cap 130*a* rests on the outer edges of the lower housing 110*d*. The bearing element 140*a* rests on the lower housing cap 130*a*. Both the lower housing cap 130*a* and the bearing element 140*a* are donut shape thus providing a hole or passageway for the center shaft 210*d* of the upper housing 150*d* to pass through.

The friction material 180*d* preferably is a cord or a belt that wraps around the center shaft 210*d* of the upper housing 150*d*. The friction material 180*d* is held in place by the fastening post 125*d* and the adjustment device 160*d*.

The adjustment device 160*d* includes a screw mechanism and a fastening mechanism. The fastening mechanism preferably is a nut 166*d* that rotates about the screw mechanism 164*d*, more preferably the nut 166*d* is a high hexagonal nut. The fastening mechanism preferably also includes a washer or similar device 167*d* that is not threaded onto the screw mechanism 164*d*, and more preferably the washer 167*d* is a high washer. The nut 166*d* moves the washer 167*d* along the screw mechanism 164*d*. Preferably the washer 167*d* is attached to the friction material 180*d* preferably using crimping; however, if the washer 167*d* is not present, then the nut 166*d* will attach directly to the friction material 180*d*.

The screw mechanism preferably is attached and connected to the engagement pieces 126*d*, 127*d* of the lower housing 110*d*. The screw mechanism runs parallel and above the slot 111*d* in the lower housing 110*d* allowing the user to rotate the fastening mechanism for adjusting the rotational resistance. The screw mechanism preferably is a threaded bolt or screw with a non-threaded end piece, and more preferably the screw mechanism is a threaded bolt 164*d* with at least one hexagonal end 162*d*. The hexagonal end 162*d* nests within a box 126*d*, which is one of the engagement pieces of the lower housing 110*d*, that has an open top and a cavity formed to engage and lock in place the hexagonal end 162*d*. The other end of the threaded bolt 164*d* rests within a second box 127*d* with an open top and a cavity formed to engage the other end of the threaded bolt 164*d*. Both ends of the threaded bolt may be further held in place with an adhesive like epoxy to prevent the threaded bolt from rotating while in place in the lower housing.

The user can adjust the amount of rotational resistance of the device by rotating the nut 166*d* along the screw mechanism 164*d* through the slot 111*d* of the lower housing 110*d*. As the nut 166*d* is turned, the friction material 180*d* is loosened or tightened around the center shaft 210*d*. If the nut 166*d* is rotated radially outward from the center of the device, then the friction material 180*d* is constricted and tightens around the center shaft 210*d*. As the friction material 180*d* is tightened the rotational resistance is increased for the upper housing 150*d* to rotate relative to the lower housing 110*d*. If the nut 166*d* is rotated radially inwardly toward the center of the device, then the friction material 180*d* will be looser around the center shaft 210*d* thus decreasing the rotational resistance between the upper housing 150*d* and the lower housing 110*d*.

One of ordinary skill in the art will appreciate that a winch mechanism may replace the screw mechanism, the fastening mechanism, and the engagement pieces in the above embodiment and still obtain the same functionality. In this modification, the friction material 180*d* will be connected to the winch. The winch will include a handle or other turning instrument accessible through the bottom of the lower housing.

One of ordinary skill in the art will also appreciate that the center shaft 210*d* may be replaced by a pulley fixed to a rod extending down from the upper housing 150*d* in place of the center shaft. The friction material 180*d* in this modification preferably wraps around the pulley such that the friction material 180*d* when viewed from above does a 180 degree turn.

Another embodiment of the regulating components is shown in FIG. 8(*a*)-(*h*). The regulating components in this embodiment are an expansion belt friction resistance apparatus. This embodiment includes the footing 100, the lower housing 110*e*, the adjustment device 160*e*, the friction material 180*e*, the lower housing cap 130*a*, the bearing element 140*a*, and the upper housing 150*e*.

The upper housing 150*e* includes a nesting unit 190*e*. The nesting unit 190*e* extends down from the top of the inside cavity of the upper housing 150*e*. The nesting unit 190*e* preferably is a hollow cylinder centered with the radial center of the upper housing 150*e*.

The lower housing 110*e* preferably is a hollow cylinder with a hole passing through the center of the bottom surface. The lower housing 110*e* includes a central passageway 111*e* divided into two sections 112*e*, 120*e* extending from the bottom surface. The two sections 112*e*, 120*e* are separated by a shelf 115*e*. The second section 120*e* includes a series of teeth around its inner perimeter, a channel 117*e* through the wall at the top of the section, and a slot 118*e* on the outside of the wall at the top of the wall spaced from the channel 117*e*. A block 220*e* is placed in the slot 118*e* such that the block 220*e* extends radially out from the center of the central passageway 111*e* to fill at least some of the space between the nesting unit 190*e* and the central passageway 111*e*. The block 220*e* acts as a stop to the friction material 118*e* wrapping any further around the central passageway 111*e*.

The lower housing cap 130*a* rests on the outer edges of the lower housing 110*e*. The bearing element 140*a* rests on the lower housing cap 130*a*.

The adjustment device preferably is a dial 160*e* with a series of teeth around its outer periphery for engaging the teeth of the central passageway 111*e*. The dial 160*e* includes a recess 163*e* in from its outside periphery along the top of the dial. The size of the recess 163*e* controls the range of rotational resistances possible with the device; because the larger the capacity of the recess 163*e* is, the more friction material 180*e* that can be stored within the recess 163*e*. The dial 160*e* also includes a knob 162*e* that is a smaller diameter than the rest of the dial 160*e* such that a shoulder is formed between the knob 162*e* and the remainder of the dial 160*e* as shown in FIGS. 8(*d*)-(*f*). The shoulder rests on the shelf 115*e* of the lower housing 110*e*. Preferably the dial 160*e* is solid.

The friction material 180*e* preferably is a belt or cord that runs from the recess 163*e* in the dial 160*e* through the channel 117*e* in the central passageway 111*e* around the central passageway 111*e* to the block 220*e* extending from the central passageway 111*e*. This structure does not require that the friction material 180*e* be attached to either of the recess 163*e* and the block 220*e* given the limited amount of rotation of the dial 160*e* is dependent on the radially width of the channel 117*e* in the central passageway 111*e*. The friction material

180*e* may be attached using adhesive such as epoxy, mechanical, or other attachment means known to one of ordinary skill in the art.

When the device is assembled the nesting unit 190*e* will fit over the friction material 180*e*, the central passageway 111*e*, the block 220*e*, and the dial 160*e*. The amount of friction material 180*e* present between the nesting unit 190*e* and the central passageway 111*e* will determine the level of rotational resistance between the upper housing 150*e* and the lower housing 110*e*.

The user can adjust the amount of rotational resistance of the device by rotating the dial 160*e*. As the dial 160*e* is turned, the amount of friction material 180*e* located between the nesting unit 190*e* and the central passageway 111*e* will change. If the dial 160*e* is turned clockwise, then more friction material 180*e* will be forced into the area between the central passageway 111*e* and the nesting unit 190*e*. With the increase presence of the friction material 180*e*, the rotational resistance is increased between the nesting unit 190*e*, which is part of the upper housing 150*e*, and the central passageway 111*e*, which is part of the lower housing 110*e*. If the dial 160*e* is turned counterclockwise, the friction material 180*e* will be retracted into the area that exists between the dial recess 160*e* and the channel 117*e*. The decrease in the amount of the friction material 180*e* present between the nesting unit 190*e* and the central passageway 111*e* will decrease the rotational resistance between the upper housing 150*e* and the lower housing 110*e*.

One of ordinary skill in the art will appreciate that a winch mechanism can replace the dial in the above embodiment to allow for the capacity to use more friction material. The more friction material available for use, the greater the range of rotational resistances that will be provided by the device.

Another embodiment of the regulating components is shown in FIG. 9(*a*)-(*j*). The regulating components in this embodiment are a push bar displacement friction resistance apparatus. This embodiment includes the footing 100, the lower housing 110*f*, the adjustment device 160, the compression component 170*f*, two push bars 230*f*, two pieces of friction material 180*f*, the lower housing cap 130*a*, the bearing element 140*a*, and the upper housing 150.

The lower housing 110*f* includes a central passageway 111*f* and a horizontal channel 113*f* that preferably is rectangular. The central passageway 111*f* and the horizontal channel 113*f* when dissected along the length of the horizontal channel 113*f* form a "T". The central passageway 111*f* preferably includes three sections 112*f*, 116*f*, 120*f*, any of which may be combined together into one section. The first section 112*f* is of sufficient diameter to allow the user to turn the adjustment device 160. The second (or threaded) section 116*f* is threaded to hold the adjustment device 160 in place during use. One of ordinary skill in the art will readily realize that the second section 116*f* can subsume the first section 112*f*. The third (or rotating) section 120*f* preferably is smooth and nests the compression component 170*f*. Each of the sections preferably has the same diameter taking into account the threads in the second section.

The lower housing cap 130*a* rests on the outer edges of the lower housing 110*f* and may also rest on the upper edge of the channel 113*f* and central passageway 111*f*. The bearing element 140*a* rests on the lower housing cap 130*a*.

The adjustment device 160 preferably is a screw mechanism 164 with a turning handle 162. The compression component 170*f* is tapered from its bottom towards its top. The adjustment device 160 and the compression component 170*f* preferably are formed as one piece (e.g., unitary).

The push bars 230*f* have tapered ends that abut the compression component 170*f*. The push bars 230*f* rest in the horizontal channels 113*f* and move radially in and out from the center. The push bars 230*f* contact the friction material 180*f*. The friction material 180*f* preferably is box shaped. The shape of the face of the friction material 180*f* that contacts the push bars 230*f* corresponds to the lateral cross-sectional shape of the push bars 230*f*, and preferably for ease in operation the friction material 180*f* has a substantially uniform cross-section in the radial direction.

The user can adjust the amount of rotational resistance of the device by rotating the adjustment device 160, the compression component 170*f* vertically moves against the push bars 230*f*. If the adjustment device 160 is turned clockwise, then the compression component 170*f* moves upwards forcing the push bars 230*f* radially out along the horizontal channel 113*f* against the friction material 180*f*. The friction material 180*f* is pressed against the inner wall of the upper housing 150 and acts as a brake on the rotation of the upper housing 150 relative to the lower housing 110*f*. The more the friction material 180*f* brakes the rotation of the upper housing 110*f*, the more rotational resistance exists for the user. If the adjustment device 160 is turned counterclockwise, then the compression component 170*f* will vertically drop and allow the push bars 230*f* to move radially inward and release some of the force imposed on the friction material 180*f*. Thus the braking force from the friction material 180*f* will decrease, and the rotational resistance between the upper housing 150 and the lower housing 110*f* will decrease.

A modification to each of the above-described embodiments is that an air bladder with a miniature pump can be inserted in place of the screw mechanism for the adjustment device. The air bladder and the miniature pump are of the types that are typically found in athletic shoes to provide additional support and/or cushion to feet.

One of ordinary skill in the art will appreciate that each of the above embodiments may be modified by replacing the upper housing with a disc and extending the lower housing main wall vertically. The extended lower housing wall is topped with a rim directed inwardly to secure the lower housing cap, the bearing element and the upper disc. The lower housing cap rests against an internal rim within the lower housing at the vertical height it would be located within each of the above embodiments. The outside rim around the lower housing is not necessary with this modification and would not be present.

To provide additional versatility to the apparatus of the invention, the user can attach the following accessories to one or a pair of these apparatuses.

The first accessory, as shown in FIG. 10, is an additional height base 260 that preferably is manufactured from the same material used to make the lower housing and upper housing, for example a rigid polymer formed using injection or rotational molding. The base 260 could also be manufactured from rubber, metal or a variety of other similar materials. The height base 260 preferably is tapered radially inward from its base to its top. A recess or cavity 262 extends in from the top surface to nest one of the apparatuses. The recess 262 will extend up around the lower housing to a point short of where the upper housing shrouds over the lower housing.

A second accessory is an attachment to allow the use of the apparatus 295 with a weight machine 290 as shown in FIGS. 11(*a*)-(*c*). The attachment preferably includes a support bar 272 with two small Velcro wraps 274 and two attachment rings 276. The support bar 272 preferably is made from metal. The support bar 272 also preferably is a flat strip of metal. The small Velcro wraps 274 are used to attach the support bar to the weight machine 290. The attachment rings 276 preferably are made from a rubber encased metal or rigid polymer ring 276*a* with the remaining portion of the ring being a Velcro wrap or cord material 276*b* to lasso an apparatus within the attachment ring 276. The attachment ring 276 wraps around the lower housing below the portion shrouded by the upper housing.

For exemplary purposes, the preferred measurements for the handle embodiment including the upper housing and the lower housing will be described and discussed. The upper housing has a diameter of 8 inches and a height of 1.5 inches. The upright portions are radially spaced in from the edge of the upper housing 0.5 inches. The shorter upright has a diameter of 1.625 inches through its entire height, and this diameter continues through the junction with the gripping area of the handle. The gripping area of the handle rises at an angle of 14 degrees from the horizontal plane along its bottom surface. The gripping area tapers similar to a conical shape such that prior to the junction with the taller upright portion the diameter is 1.0625 inches, which is maintained through the junction and into the taller upright portion. The taller upright portion tapers out to a base with a diameter of 1.375 inches. The upper housing thickness is 0.2±0.02 and the upper housing rim thickness is 0.30±0.02. The lower housing has a diameter, not including the rim, of 7.5±0.02 and wall thickness of 0.44±0.02 inches. The lower housing cap also has a diameter of 7.5±0.02 inches.

Those skilled in the art will appreciate that various adaptations and modifications of the above-described preferred embodiments can be configured without departing from the scope and spirit of the invention. In particular, one of ordinary skill in the art will appreciate that the invention may be assembled such that any reference above to clockwise and counterclockwise motion may be swapped such that counterclockwise will provide the effect discussed for clockwise. Therefore, it is to be understood that, within the scope of the appended claims, the invention may be practiced other than as specifically described herein.

I claim:

1. An exercise system comprising:

two exercise devices, each of said exercise devices includes an upper platform, means for providing padding for a clinched fist to rest in while performing a push-up, said padding means attached to said upper platform, a lower housing engaging said upper platform, a bearing element between said lower housing and said upper platform, and regulating components that control the level of resistance to rotation between said lower housing and said upper platform, said regulating components are within a space formed by said upper platform and said lower housing;

a support bar having two ends;

a first attachment ring near one end of said support bar;

a second attachment ring near the other end of said support bar;

a first Velcro loop on a side opposite said first attachment ring, said first Velcro loop capable of attaching to a weight machine; and a second Velcro loop on a side opposite said second attachment ring, said second Velcro loop capable of attaching to a weight machine;

wherein each of said attachment loops wrap around a respective lower housing of one of said exercise devices.

2. The exercise system according to claim 1, wherein each exercise device further includes a base having a cavity sized to fit around and cover a portion of said lower housing.

3. The exercise system according to claim 2, wherein the height of the cavity in each base is less than a distance from a bottom of said lower housing to a bottom of said upper platform.

4. The exercise device system according to claim 2, wherein each base is tapered radially inward from a bottom to at least a bottom of said cavity.

5. The exercise system according to claim 1, wherein each exercise device further including a base having a cavity, the cavity is sized to provide a space into which the lower housing fits, and the cavity covers a portion of an exterior of said lower housing.

6. The exercise system according to claim 5, wherein the height of the cavity in said base is less than a distance from a bottom of said lower housing to a bottom of said upper platform such that the lower housing extends from a top of said base.

7. The exercise system according to claim 1, wherein each exercise device further including an additional height base that includes a cavity in which said lower housing fits in to raise said lower housing further from a surface on which said exercise device sits.

8. An exercise device comprising:

an upper platform, a handle having two upright sections connected by a gripping member, a lower housing engaging said upper platform, a bearing element between said lower housing and said upper platform, and regulating components that control the level of resistance to rotation between said lower housing and said upper platform, said regulating components are in connected to said upper platform and said lower housing and enclosed by said upper platform and said lower housing.

9. The exercise device according to claim 8, wherein said regulating components provide a variable and adjustable level of resistance.

10. The exercise device according to claim 8, wherein said upper platform includes a cylindrical wall extending down and covering at least a portion of said lower housing.

11. The exercise device according to claim 8 further comprising a base having a cavity sized to fit around said lower housing, said lower housing extending up from said base, and a top of said base is spaced from said upper platform.

12. An exercise system comprising:

two exercise devices for performing a push-up with a clinched fist, wherein each of said exercise devices includes an upper platform, a pad attached to and extending up from said upper platform, said pad having sufficient thickness to provide padding for a clinched fist during the performance of a push-up using said exercise device, a lower housing engaging said upper platform, a bearing element between said lower housing and said upper platform, and regulating components that control the level of resistance to rotation between said lower housing and said upper platform, said regulating components are within a space formed by said upper platform and said lower housing;

a support bar having two ends;

a first attachment ring near one end of said support bar;

a second attachment ring near the other end of said support bar;

a first Velcro loop on a side opposite said first attachment ring, said first Velcro loop capable of attaching to a weight machine; and a second Velcro loop on a side opposite said second attachment ring, said second Velcro loop capable of attaching to a weight machine;

wherein each of said attachment loops wrap around a respective lower housing of one of said exercise devices.

13. The exercise system according to claim 12, wherein each exercise device further including a base having a cavity sized to fit around said lower housing, said lower housing extending up from said base, and a top of said base is spaced from said upper platform.

14. The exercise system according to claim 13, wherein the height of the cavity in each base is less than a distance from a bottom of said lower housing to a bottom of said upper platform.

15. The exercise system according to claim 13, wherein said base is tapered radially inward from a bottom to at least a bottom of said cavity.

16. The exercise system according to claim 12, wherein each exercise device further includes a base having a cavity, the cavity is sized to provide a space into which the lower housing fits, and the cavity covers a portion of an exterior of said lower housing.

17. The exercise system according to claim 12, wherein the height of the cavity in said base is less than a distance from a bottom of said lower housing to a bottom of said upper platform such that the lower housing extends from a top of said base.

18. The exercise system according to claim 12, wherein each exercise device further includes an additional height base that includes a cavity in which said lower housing fits in to raise said lower housing further from a surface on which said exercise device sits.

* * * * *